US007575198B2

(12) United States Patent
Hardham et al.

(10) Patent No.: US 7,575,198 B2
(45) Date of Patent: Aug. 18, 2009

(54) CONTROL HANDLE FOR USE WITH A TOWABLE AIRFOIL

(75) Inventors: Corwin Hardham, Cooks, WA (US); Johannes Van Niekerk, Sunnyvale, CA (US)

(73) Assignee: Ho Sports Company, Redmond, WA (US)

( * ) Notice: Subject to any disclaimer, the term of this patent is extended or adjusted under 35 U.S.C. 154(b) by 15 days.

(21) Appl. No.: 11/927,344

(22) Filed: Oct. 29, 2007

(65) Prior Publication Data

US 2008/0128558 A1 Jun. 5, 2008

Related U.S. Application Data

(60) Provisional application No. 60/863,309, filed on Oct. 27, 2006.

(51) Int. Cl.
*B64D 17/14* (2006.01)

(52) U.S. Cl. ..... 244/155 A; 244/152; 244/901; 244/904; 294/153; 294/171

(58) Field of Classification Search ..... 244/155 A, 244/152, 155 R, 901, 902, 904; 294/153, 294/171

See application file for complete search history.

(56) References Cited

U.S. PATENT DOCUMENTS

| | | | | |
|---|---|---|---|---|
| 3,413,692 | A | 12/1968 | Pressley | |
| 3,498,574 | A | 3/1970 | Ernst | |
| 4,557,439 | A | 12/1985 | Puskas | |
| 4,641,597 | A | 2/1987 | Paxton | |
| 4,733,625 | A | 3/1988 | Allen | |
| 4,811,470 | A | 3/1989 | Van Sloun | |
| 4,893,577 | A | 1/1990 | Jennings | |
| 4,944,074 | A | 7/1990 | Bullat et al. | |
| 5,094,638 | A | 3/1992 | Kobayashi | |
| 5,195,223 | A | 3/1993 | Tylaska | |
| 5,366,182 | A | 11/1994 | Roeseler et al. | |
| 6,085,682 | A | 7/2000 | McCulloh | |
| 6,364,251 | B1 | 4/2002 | Yim | |
| 6,453,839 | B2 | 9/2002 | Roeseler et al. | |
| 6,581,879 | B2 * | 6/2003 | Bellacera | 244/155 A |
| D482,649 | S | 11/2003 | Eck | |
| 6,666,159 | B2 | 12/2003 | Larson et al. | |
| 6,688,553 | B2 | 2/2004 | Hsia | |

(Continued)

FOREIGN PATENT DOCUMENTS

| | | |
|---|---|---|
| WO | WO2008014524 | 1/2008 |

(Continued)

*Primary Examiner*—J. Woodrow Eldred
(74) *Attorney, Agent, or Firm*—Ganz Law P.C.

(57) ABSTRACT

For use with towable airfoils used to supply lift to a towed rider to assist with jumping in sports and recreation, a handle system having one or more control lines for coupling to the airfoil, and a line for coupling the handle to a tow vehicle, the one or more control lines and line for coupling to the tow vehicle being coupled together by a tension translation mechanism that divides the tension from the line for the tow vehicle to the one or more control lines by a predetermined factor, which typically would be other than 1:1. The handle system may further include an engagement mechanism for engaging the one or more control lines to lock or brake a line.

25 Claims, 21 Drawing Sheets

U.S. PATENT DOCUMENTS

| | | | | |
|---|---|---|---|---|
| 6,834,607 | B1 | 12/2004 | Johnson et al. | |
| 7,032,864 | B2 | 4/2006 | Logosz | |
| 7,114,457 | B1 | 10/2006 | Stiers | |
| 7,182,294 | B2 * | 2/2007 | Blackman | 244/155 A |
| 2006/0102794 | A1 | 5/2006 | Quijano | |
| 2006/0189229 | A1 | 8/2006 | Parten | |
| 2006/0226294 | A1 * | 10/2006 | Logosz et al. | 244/152 |

FOREIGN PATENT DOCUMENTS

| | | |
|---|---|---|
| WO | WO2008014525 | 1/2008 |

* cited by examiner

DETAIL B

CONTROL HANDLE FOR USE WITH A TOWABLE AIRFOIL

CROSS REFERENCE TO RELATED APPLICATIONS

Under 35 U.S.C. §119, this application claims the benefit of and priority to U.S. provisional patent application No. 60/863,309, filed Oct. 27, 2006 by Corwin Hardham, et al. entitled A TOWABLE AIRFOIL SYSTEM AND COMPONENTS AND ACCESSORIES THEREFOR the contents of which are hereby incorporated by reference as if included in their entirety for all purposes.

BACKGROUND

The inventive subject matter disclosed herein relates to control handles and lines for airfoils used to provide lift or tension on a tow line, particularly for use in recreational sports. The inventive subject matter particularly relates to airfoils, and handle systems, and line systems for use in water sports, such as wakeboarding and kite-boarding. Although not limited to such applications, they will be used to illustrate the inventive subject matter.

Towable water sports devices are used in various recreational and professional activities. These devices include water skis, kneeboards, wakeboards, water ski boards, tubes and other devices which are towed behind a motor boat or other towing vessel along with a rider. Typically, the rider stands, kneels, or sits on the device, and a tow line is held by the rider or attached to the device.

Wakeboarding, for example, is a recreational and professional sport that is rapidly increasing in popularity. In wakeboarding and other water sports, it is often desirable to jump off the water surface to add excitement to the activity, perform tricks or other aerial maneuvers, etc. Often, the wake created by the towing vessel is used as a ramp to facilitate jumping off the surface of the water. However, regardless of the amount of wake present, riders will often want to maximize the ability to jump off the water surface.

In response to this need, a new sport has emerged that allows riders to jump of the surface by coupling themselves to a towed airfoil that provides vertical lift even when there is little or no wake present. A towable airfoil lift system was created and disclosed in U.S. Pat. No. 6,834,607, granted Dec. 28, 2004, entitled TOWING SYSTEM AND METHOD FOR A WATER SPORTS APPARATUS the contents of which are hereby incorporated by reference as if recited in full herein for all purposes. (At the time of the inventions disclosed herein, the '607 patent was owned by a common assignee.) While the lift system disclosed in that patent has provided a platform for a new sport, new challenges have arisen from the use of the system that require further innovation and attention to make the new sport more controllable, learnable, and enjoyable. Among the new challenges is a need for better kite control during the use. In particular, there is a need for better control of airfoil pitch which directly translates to how much power (pull) the kite exerts on the rider. Too much pull could cause a rider to be pulled undesirably high and too little pitch may lead to insufficient height, or pitch could be erratic during flight, causing a rider to lose control.

The challenge is not simply met by implementing kite control systems known in other sports, for example, kite boarding (free-flying, untowed kites). Such sports do not have the additional force and dynamics of a tensioned, towline coupled to the rider and/or kite. Accordingly, there is an immediate and unsolved need for innovation that intelligently factors in the requirements of the new sport and the dynamics and force of a coupled towline.

SUMMARY

The inventive subject matter addresses the aforementioned needs and provides an elegant solution enabling better pitch control of a towed airfoil coupled to a rider. The inventive subject matter may be implemented in a variety of applications, including wherever a towed airfoil may be used to provide a rider vertical lift. Such applications include not only towing over water surfaces, but also towing over ground, ice, and snow surfaces. For convenience, the following discussion will be in the context of wakeboarding using a water launched kite.

In one possible embodiment the inventive subject matter is directed to: a handle system for controlling the pitch of an airfoil, comprising: a housing with a channel for a first kite control line to be movably routed, and a channel for a second kite control line to be movably routed; the channels having a first opening or openings that allow the control lines to extend forward of the handle for coupling with a tow line; the channels having second openings that allow the control lines to extend upwardly for coupling to an airfoil; and wherein the channels are arranged so that an increase in tension of a coupled towline is translated to the control lines. In this and other embodiments, the handle system may include at least one engagement mechanism arranged, the mechanism being engageable against the movable lines to lock or brake them. In this and other embodiments, the engagement mechanism may include levers that depress against a line. In this and other embodiments, the engagement mechanism may include a line engagement element arranged in the system so that rotation of the handle from a normal position used in towing over a surface to a second causes the line engagement element to engage a line to lock or brake it. In this and other embodiments, the line engagement element may include a tapered slot or a jam-cleat. In this and other embodiments, the handle system may include left and right rear control lines routed through the handles. In this and other embodiments, the handle system may include one or more pulleys associated with the handle so that the a control line is coupleable around a pulley to a tow line so that the translated tension on the kite lines is divided by a factor other than 1:1. In this and other embodiments, the handle system may include left and right rear control lines routed through the handles, and a first pulley is disposed forward of the handle and a single section of line coupled to the left and right control lines is routed around the first pulley. In this and other embodiments, the handle system may include at least one pulley in the handle housing around which the single section of line is disposed. In this and other embodiments, the handle system may include second and third pulleys disposed in the handle around which the left and right control lines are respectively disposed in routing from the first openings of the handle to the second openings. In this and other embodiments, first opening or openings may be disposed in a central portion of the housing, and the second openings are disposed at ends of the handle. In this and other embodiments, a set of left and right front control lines may coupled to the handle. In this and other embodiments, left and right rear control lines exit the housing respectively into channels of the left and right front control lines. In this and other embodiments, the engagement mechanism may be a dampening element which allows for relatively rapid increase of angle of attack on tensioning of the tow line and relatively slow decrease of angle of attack on reduction or removal of the tensioning force. In this and other embodiments, there may be an engagement mechanism associated with the handles so that there is an offset exit for a kite line relative to about the center of the handle so that a dominant towline tension keeps the engagement disengaged and a dominant control line causes rotation so that the engagement mechanism is engaged.

In another possible embodiment the inventive subject matter is directed to a pitch control system for a towable air foil, the system including: a handle and at least two control lines for coupling to an airfoil, and at least one line for coupling to a towline, being movably associated with the handle, and the control lines are coupled to the line that is coupleable to the tow line so that tension on the towline is transferred to the control lines; an engagement mechanism for engaging at least one of the lines so that when the control lines are coupled to a kite, the pitch of the kite may be set by engaging the engagement mechanism. In this and other embodiments, the pitch control system may include an air foil sized and shaped for towing behind a vehicle and assisting a rider with lift for controlled jumps, the airfoil including coupling for coupling to the control lines.

In another possible embodiment the inventive subject matter is directed to a method of using an airfoil, comprising: providing a rider a handle system enabling pitch control over an airfoil, the handle system also including front and rear control lines for coupling to front and rear positions at the left side of an airfoil, and front and rear control lines for coupling to front and rear positions at the right side of the air foil; and wherein the system is configured to translate tension from a tow line coupled to the handle system to the rear control lines to cause change in pitch of the airfoil. In this and other embodiments, the method of using an airfoil may include providing the airfoil for coupling to the handle system. In this and other embodiments, the method of using an airfoil may include coupling the handle system to the tow line of a tow vehicle. In this and other embodiments, the airfoil may be configured for towing and launching off a water surface, and the tow vehicle may be a boat or other watercraft.

In another possible embodiment, the inventive subject matter is directed to a handle system that has one or more control lines for coupling to an air foil and a tow line, or line for coupling to a tow line of a two vehicle, the one or more control lines and the tow line, or line for coupling to the tow line, being coupled together by a tension translation mechanism that divides the tension from the tow line to the one or more control lines by a predetermined factor. In this and other embodiments the handle system may include an engagement mechanism for engaging the one or more control lines to lock or brake a line. In this and other embodiments, the handle system may include a handle system wherein the engagement mechanism automatically locks or brakes a line upon rotation of the handle. In this and other embodiments, the engagement mechanism provides an offset exit for a kite line relative to about the center of the handle so that a dominant towline tension keeps the engagement disengaged and a dominant control line causes rotation so that the engagement mechanism is engaged. In this and other embodiments, the handle may be associated with an engagement system providing a mechanical dampener and/or dampening material coupleable to a control line that is coupled to a towline.

BRIEF DESCRIPTION OF THE DRAWINGS

The following figures show various embodiments of inventive subject matter (except where prior art is noted).

FIG. 2A is a front, right perspective view of a kite, FIG. 2B is a top perspective view, FIG. 2C is a right side elevational view, FIG. 2D is a front view, FIG. 2E is a rear view, and FIG. 2F is a plan view.

FIG. 8A top view of an assembly of a handle (partially shown) and rear and front control lines wherein the handle includes an alternative embodiment engagement mechanism.

DETAILED DESCRIPTION

Figure 1A:
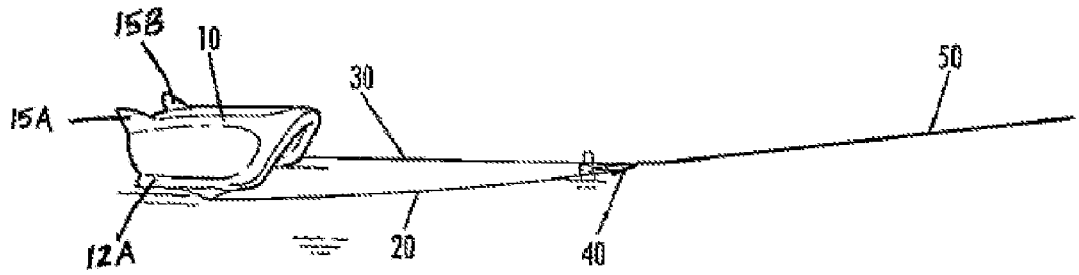
FIG. 1A shows some basic elements of one possible embodiment of a lift system in a pre-launch set-up.

The inventive subject matter is generally directed to a control system that controls the angle of attack (pitch) of a towed airfoil in a manner responsive to the needs of a rider who is coupled by a set of lines to the airfoil and the towing vehicle. An airfoil may be not only a kite, but also it could be a wing or blade, for example. The airfoil is particularly useful in providing lift to an object coupled to the airfoil via a tensioned line. In the case of a wakeboard rider, for example, the control system facilitates control over the pitch of the airfoil when a rider needs to maintain or increase the power (lift) of the airfoil. Under such circumstances, the maintenance in or increase of pitch angle helps supply vertical lift, enabling the rider to jump higher, sustain longer hang time, and/or land more softly, and, also, upon landing, the inventive system allows the kite to readily "sheet-out," disengaging it, so there is less exertion on the rider. The airfoil is towable behind a vehicle, such as a boat, automobile, snow mobile, or other any other surface vehicle. For purposes of illustrating the inventive auto-stabilizing airfoil, a lift system towable by a boat for assisting a wakeboarder or water skier is described below. As used herein, the term "rider" will refer to any person who is coupled by lines to an airfoil towed behind a vehicle, and the tow vehicle.

The following description will be in terms of an airfoil in the nature of a kite. However, this is an illustrative example, and the inventive subject matter may be readily adapted for use with other forms of airfoils.

The pitch control system may be used with any form of towed airfoil that has pitch controls lines. Examples of suitable airfoils are disclosed in U.S. Pat. No. 6,834,607, and International Patent Application Numbers PCT/US07/74777 and PCT/US07/74778 filed Jul. 30, 2007, by Corwin Hardham, et al., which are each incorporated by reference in their entireties. A particularly suitable airfoil in one that is auto-stable. As used herein, an "auto-stable airfoil" means an airfoil that tends to fly at a zenith, centered overhead, position and tends to recover, without rider input, from non-constant forces that cause yaw or roll perturbations during intended conditions of use. Representative configuration factors for certain auto-stable airfoils are detailed in the aforementioned PCT applications. The aforementioned international applications also detail line coupling and release systems for releasably coupling various lines together, which may help make use of the system safer.

A suitable airfoil, line system, and coupling and release systems for use with the inventive control handle are commercially available from HO Sports, Inc. Redmond, Wash., USA under the name WakeKite® SuperFly™ 9.0. A User Manual with guidelines on use and operation of the lift system is available from the same source and includes safety considerations that should be reviewed before using the lift system. The manual is also currently downloadable from www.wakekite.com.

Figure 1B:
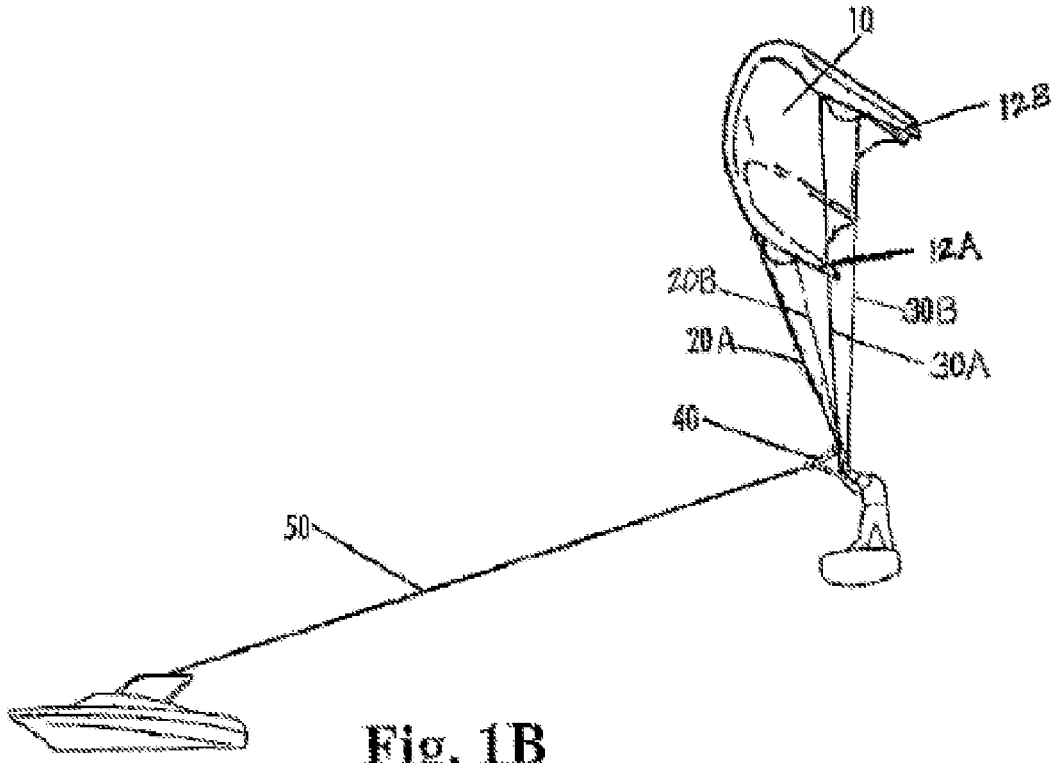
FIG. 1B shows the system of FIG. 1A after launching.

FIGS. 1A-1B illustrate basic components of a towable airfoil system. The system includes a kite 10, right and left control lines 20 and 30, which are coupled to the kite and a rider via a handle 40, for example, and a towline 50 coupled to a boat or other tow vehicle and the rider via handle 40, for example. For recreational water sports, such as wakeboarding and water skiing, safe tow speeds typically range from about 18 mph to about 24 mph. For water-launching, the airfoil will have inflatable or otherwise buoyant tips 12A and 12B.

Figure 2A:
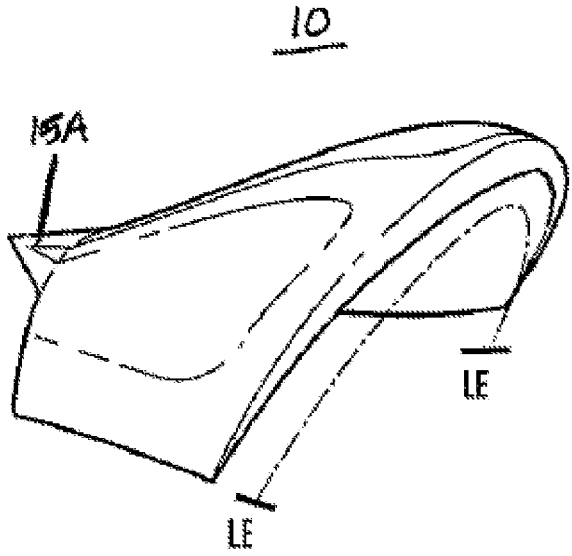
FIGS. 2A-2F show basic dimensions of a kite.
Figure 2B:
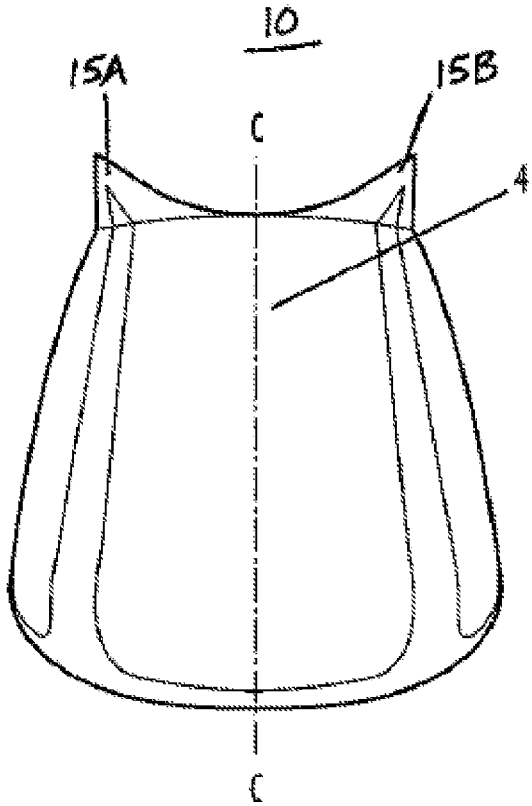
Figure 2C:
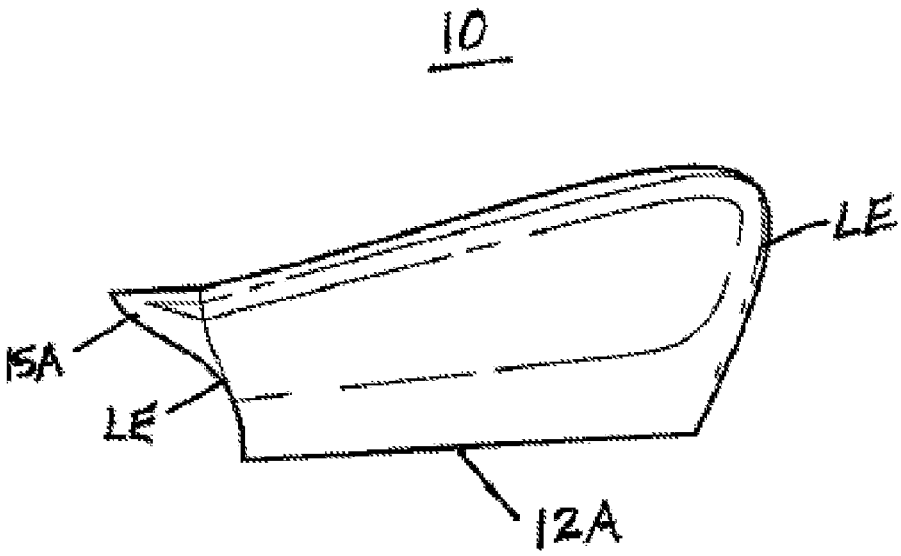
Figure 2D:
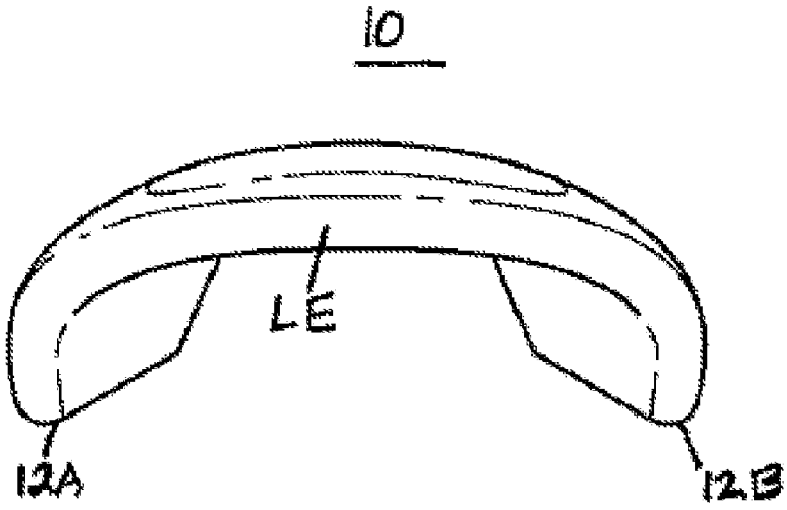
Figure 2E:
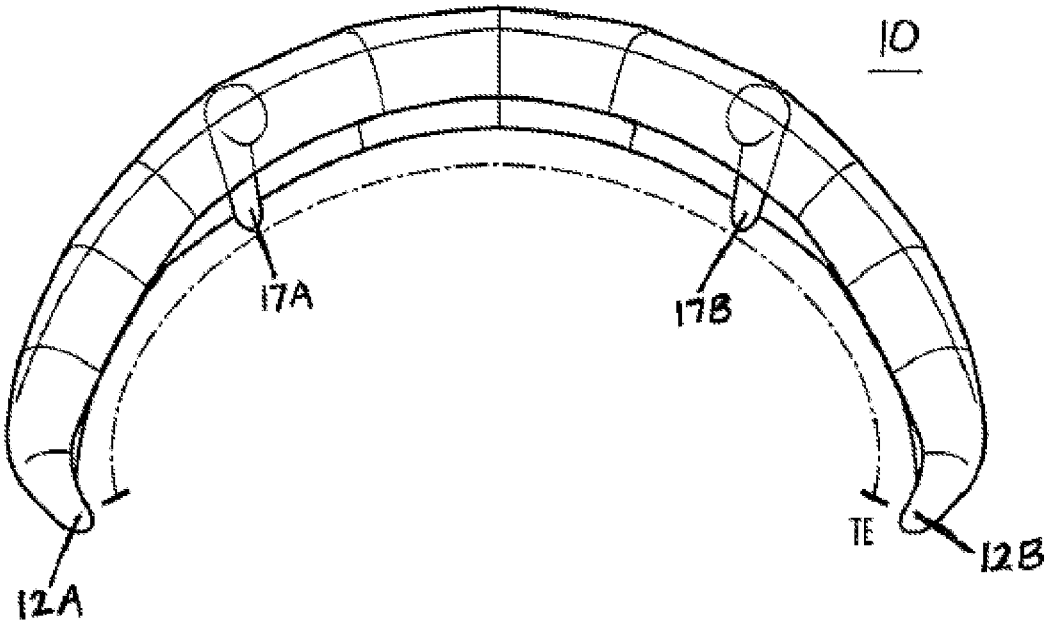
Figure 2F:
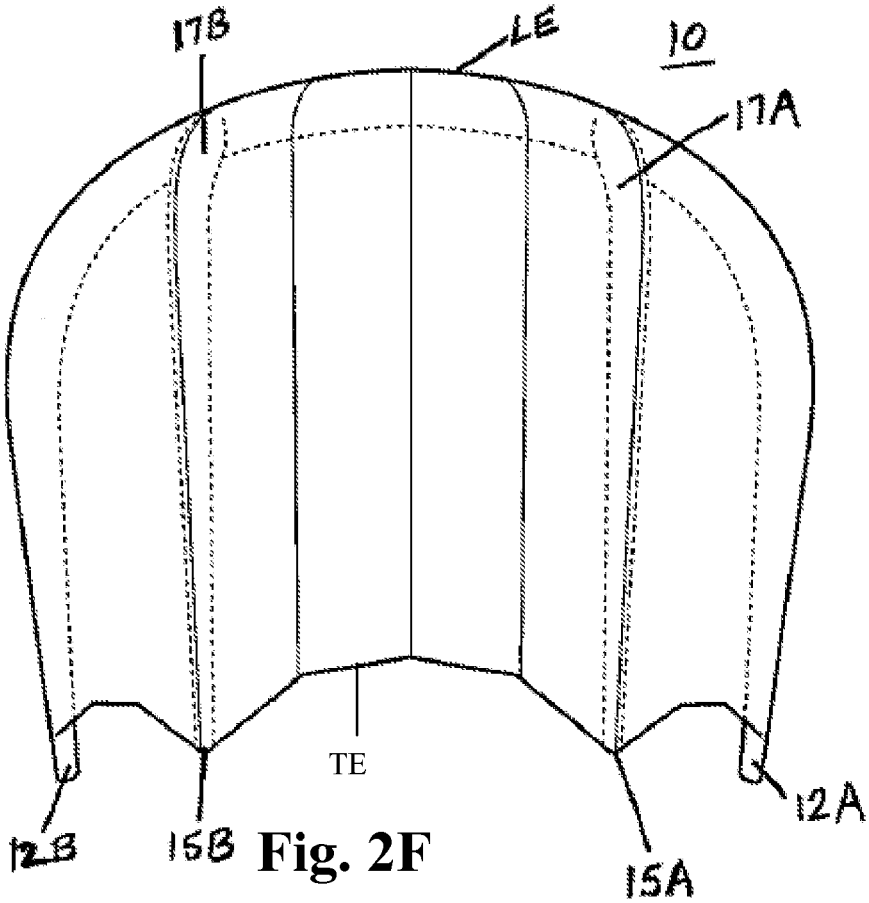

FIGS. 2A-2F show basic features and dimensions of a kite 10. FIG. 2A is a plan view of the projected span (PS) of a kite according to the inventive subject matter. In general, a kite has a leading edge indicated by line LE-LE, and a trailing edge generally indicated by line TE-TE. The kite has a chord, indicated by line C-C running down the center of the span, from the leading edge to the trailing edge. The kite has a profile alignment point P, which is a point on the chord C-C that is a predetermined percentage of the chord length, measuring from the leading edge side of the chord, and which corresponds to the kite's center of pressure "CoP". Normally, the kite's tow point is positioned a small distance behind the CoP. The illustrated kite includes drag elements 15A and 15B, and inflatable structural struts 17A and 17B. The leading edge LE and/or tips 12A and 12B may also be in the form of inflatable elements, to support a particular profile and/or to assist with water launching. In this example, the kites has an aspect ration of from about 1:1 to about 2:1 and a shallow convex profile wherein the leading edge to length ratio is from about 3:1 to about 2:1. The foregoing kite description is merely to illustrate one possibly suitable airfoil for use with the inventive subject matter, and the inventive subject matter is not intended to be limited to this description.

An airfoil is typically connected to kite control lines using bridle lines. A bridle line is a length of line that has end points that connect along a side of the airfoil, about the tow point. Each of the kite's sides has a bridle line. There may be connection points on each bridle line for receiving one or more lines that are coupled directly or indirectly to a rider or tow vehicle.

In a four line system, there are front and rear lines coupled to each side of a kite. The lines may be controlled so that the angle of attack, also referred to as "pitch", may be adjusted by a rider while the airfoil is in flight. For example, pulling in on the rear lines relative to the front lines will cause the rear of the kite to drop (referred to as "sheeting in"), increasing the angle of attack of the kites. By maintaining or increasing pitch, before or during a jump, the kite continues to be powered, allowing for higher jumps, longer hang time, and more controlled descents by the rider, and, also, upon landing, the inventive system allows the kite to readily "sheet-out," disengaging it, so there is less exertion on the rider.

As depicted in the figures, the airfoil 10 may be connected to a tensioned line such as a tow line 50 from a power boat. The rider grips a handle 40 that is a coupling between the tow line from the boat and the control lines 20A-B and 30A-B for the kite, which extend to the kite's right and left sides. Alternatively, the lines may be coupled to the rider by other means, such as a vest or harness worn by the rider. The control lines couple the force of the airfoil to the handle and allow control of one or more aspects of the flight profile (e.g., steering and pitch) of the airfoil. The opposite ends of the control lines are coupled to the airfoil.

The airfoil 10 is steered by articulating the handle in a side-to-side motion to change tension on right and left control lines 20, 30. The handle 40 is coupled to a tow line 50, either directly or with lead lines extending from the handle and coupled to the tow line. Airfoil control lines 20, 30 are also at one end directly or indirectly connected to the handle 40 and at the other end to a connection point directly or indirectly on the body of the airfoil. A typical indirect connection would be bridle lines on the kite. In the specific example shown, there are opposing airfoil lines at each end of the handle. In one possible embodiment, the lines emanate from the end faces of the handle so that the rotation of the handle by the rider does not wind the lines around the handle, as might occur if the lines emanated along the lengthwise surface of the handle.

The foregoing arrangement of lines provides a vertical force component behind the boat at the handle, enabling higher jumps, longer hang-time, and/or softer landings for the rider, and, also upon landing, the inventive system allows the kite to readily "sheet-out," disengaging it, so there is less exertion on the rider. The line system allows steering of the airfoil, which can increase the speed of the airfoil for larger jumps. Another possible line system for achieving this result is as described in U.S. Pat. No. 6,834,607, incorporated by reference above. In that system the airfoil control line(s) is coupled to the towline, so that the towline is provided with a vertical force component that is translated to the rider.

In the example shown, the opposite ends of control lines 20A-B and 30A-B are coupled to bridles 22, 32, or other couplings typically disposed at the front portions of the tips of the airfoil. Lines 20A and 30A are front lines that couple at forward points and lines 30A and 30B are rear lines that couple at rearward points. The tow point of the kite is normally between the connection points of the front and rear lines on the bridles.

In some embodiments, each side of the airfoil has a bridle line composed of two sections 22A, 22B and 32A and 32B—an elastic section and an inelastic section. An inelastic section 22A, 32A has an end that connects to the front portion of the airfoil. The elastic section 22B, 32B is rearward of the inelastic section and has an end that connects to a point rearward of the inelastic section's connection point. The elastic rear section of the bridle allows the tow point to move backward relative to the center of the lift pressure of the airfoil when the airfoil is at a lower angle of attack, which restores lift power to the airfoil, creates drag, and prevents over-flying. The bridle may be provided with multiple attachment points representing different degrees of attainable pitch. This allows a user to determine power ranges based, for example, on wind conditions or rider experience levels.

A four line system may be used to control an airfoil's angle of attack by adjusting the attitude of the leading edge relative to the trailing edge. By so controlling the airfoil's angle of attack, the rider may vary the amount of lift provided to the airfoil.

Figure 3A:
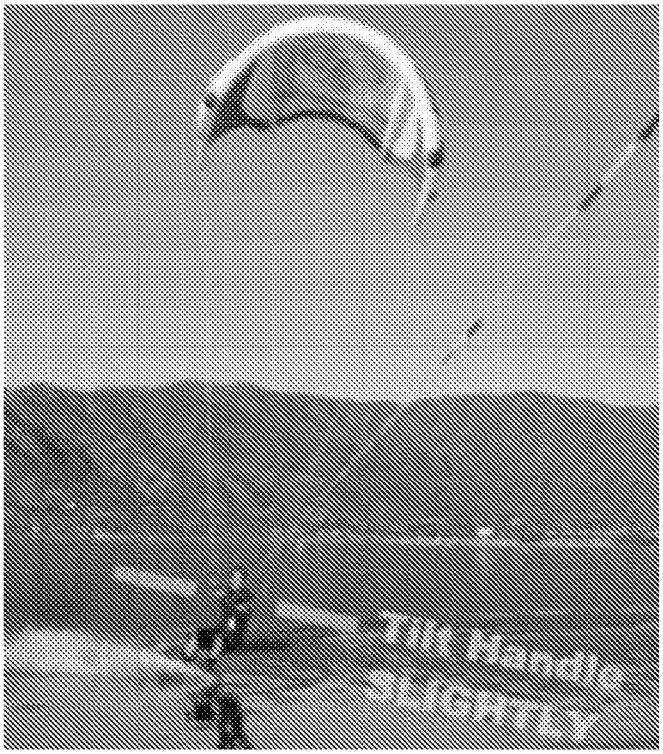
FIGS. 3A-D show a sequence of maneuvers which may be executed using airfoil, handle and line systems disclosed herein.
Figure 3B:
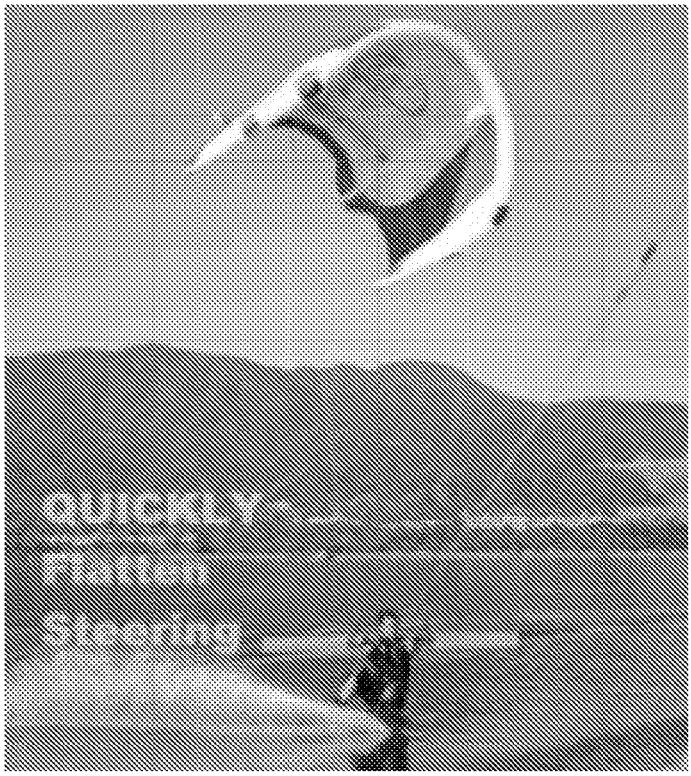

FIGS. 3A to 3D show a general overview of the jumping process for a wakeboarder using a two line kite. First the kite is steered with edging to approximately 20 feet outside the wake, allowing the kite's direction and pull to assist in the process. Once outside the wake, steer the kite gently back towards the wake. In FIG. 3A, the rider cuts towards the wake and at the same time tilts the inside (wake-side) handle end downwardly, causing the kite to steer towards the wake. (The kite should not be steered aggressively towards the wake.) As the kite begins to pull towards the wake, the rider begins slowly edging in the direction of the wake, which edging increases tension on the tow line. Referring to FIG. 3B, once edging toward the wake has begun, the rider immediately flattens out the steering handle—this is known as "flicking the kite." Kite flicking causes the kite to go upwards, helping the rider to catch air instead of being pulled across the wake. The rider should initiate kite flick well before reaching the wake.

Figure 3C:
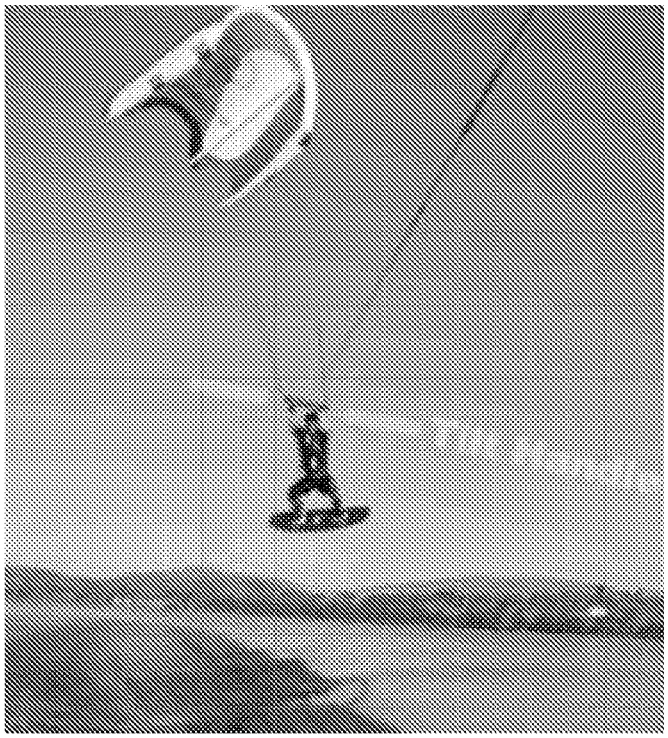

Referring to FIG. 3C, once in the air, the rider steers the kite to control the jump direction. By tilting the handle to steer the kite in the original wake-approach direction, the lift of the kite may be used to be carry the rider farther over the wake, potentially into the flats for a softer, smoother landing. If the rider desired to land in the middle of the wake, this may be achieved flattening the handle.

Figure 3D:
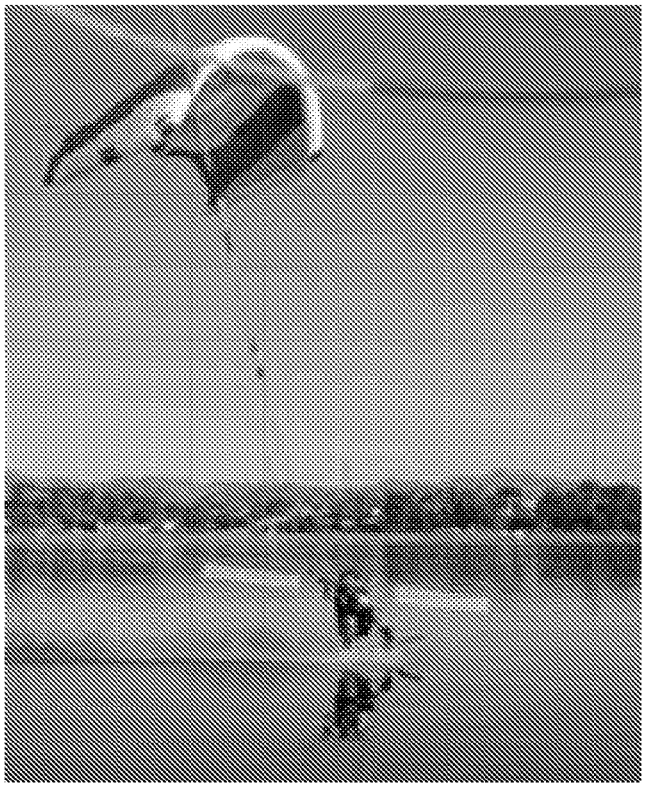

Referring to FIG. 3D, when landing, the rider needs to remain aware of the kite's position before, during and after landing. If the kite veers or dives suddenly, the rider may correct with steering or dropping the handle to avoid kite crashing.

The kite in FIGS. 3A-3D is shown with a two line control system. A two line system does not allow for substantial pitch control. Lift however increases due to the increase in the kite's speed as it travels transverse to the wake. There is a need for better control over lift. This may be achieved using a four line system so that pitch adjustments can be made. However, until the inventive subject matter, there has been no solution for enabling a rider control over pitch according to the dynamics of jump initiation, flight and landing.

In the general context of the aforementioned lift and line systems, the inventive subject matter contemplates a pitch control system for allowing a rider to control the pitch or angle of an airfoil. In one possible embodiment of a pitch control system, depicted in FIGS. 4A-G, a set of front control lines 20A and 30A (not shown) are coupled to opposite sides of a handle 40. These lines are fixed to the handle. A set of rear control lines 20B and 30B for controlling airfoil pitch are routed through channels provided on or in handle 40, and are movably coupled to the tow line 50 and kite 10. By coupling the tow line to the rear lines, the system is adapted to maintain or facilitate an increase in pitch angle when there is an increase in the tension on the tow line due to edging, for example. The increased tension on the tow line is transferred to the rear lines, for example, as a rider departs from a neutral position behind a tow boat and edges and cuts toward the boat's wake, the tension on the tow line naturally increases, which advantageously gives the rider increased pitch just when needed. Under such circumstances, an increase in pitch angle will provide greater vertical lift, enabling the rider to jump higher, with longer hang time and softer landings, and, also upon landing, the inventive system allows the kite to readily "sheet-out," disengaging it, so there is less exertion on the rider. As described in more detail below, the handle 40 includes an engagement mechanism that allows for manual or automatic locking of the rear lines so that the increased pitch is maintained through desired phases of the jump, flight and landing. (Although this following description is described in terms of movability of the rear lines and fixation of the front lines to cause a change in pitch of the airfoil, it is also contemplated that the rear lines may be fixed and the front lines may be moveable between the airfoil and the handle to cause the same relative change in airfoil pitch.)

A tension translation mechanism may be included in the system to translate forces from one set of lines to another according to a predetermined division factor. For example, one or more pulleys may be disposed between the handle and the tow line, the tow line is coupled to the rear lines by a line section that goes around the pulleys. As shown in the example system of FIGS. 4A-G, a pair of right and left rear lines, respectively 20B and 30B, are routed through channels in the handle 40, each channel being associated with one or more pulleys 101, 102, 103. (These lines are not necessarily separate, but may be a single line coupled to bridles at opposite sides of the airfoil.) One end of line 20B is routed out the right end of the handle. One end of line 30B is routed out the left end of the handle. These ends couple to the kite. The other end of line 20B is routed around pulley 101 on the side facing pulley 102. The other end of line 30B is routed around pulley 103 on the side facing pulley 102 The lines 20B, 30B continue forward of the handle and converge into a single section of line 60. That section of line loops over a pulley wheel 104 disposed between the handle 40 and tow line 50, and then over pulley wheel 102, and then back to the support structure for pulley wheel 104, where its free-end attaches. The pulley wheel 104 is mounted in a housing or other structure 105 that is coupled to the tow line 50.

Accordingly, the system couples the rider's pull on the handle to the rear lines of the airfoil. Therefore, the harder the rider pulls, the more the angle of attack increases. While riding straight, there is almost no upward pull from the airfoil, but when edging, the airfoil's attitude would change substantially with a correspondingly large increase in lift. The use of tension translation mechanism, such as pulleys allows the mechanical advantage of dividing the force on the tow line and applying the divided force to the rear control lines for the kite to effect an increase angle of attack and hence lift. The division of force is used because the tension on the towline may be much higher than that needed to change the angle of attack. The use of pulleys is optional, and it may be desired to couple the rear lines and tow lines directly instead of with pulleys. Accordingly, the number and arrangement of pulleys, if any, may be varied to provide a range of force translation from towline to control lines. Force translation also allows the kite to "sheet-out" (return to neutral) following a landing, i.e., on landing there typically would be no edging force on the towline that would sustain sheeting-in (increased pitch) of the kite.

Figure 4A:
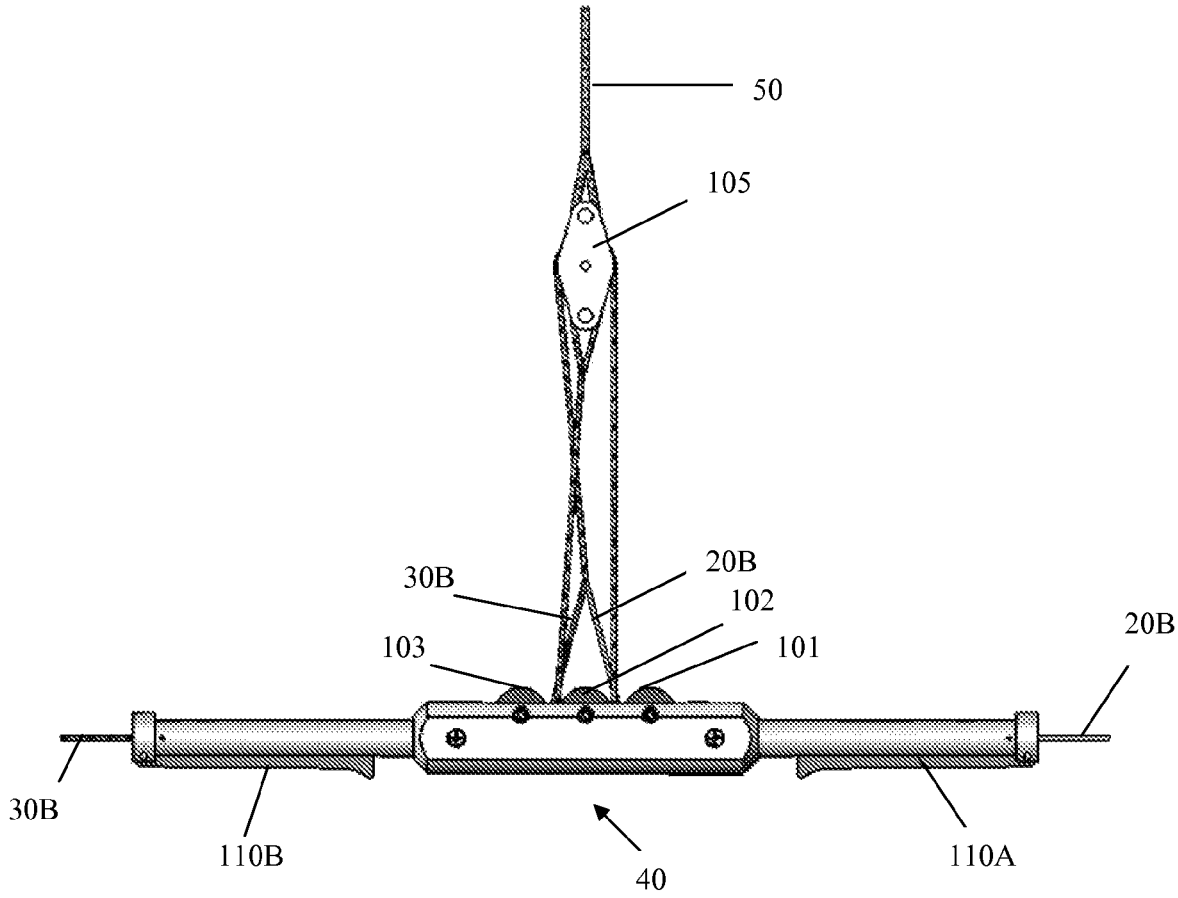
FIG. 4A shows a top view of an assembly of handle and lines for pitch control.
Figure 4B:
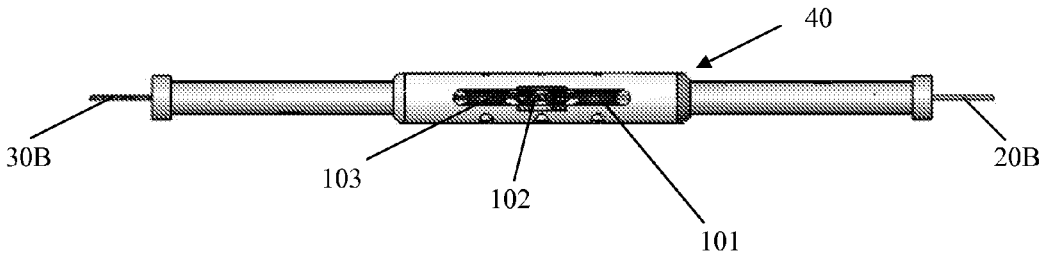
FIG. 4B shows a front view of the assembly of FIG. 4A.
Figure 4C:
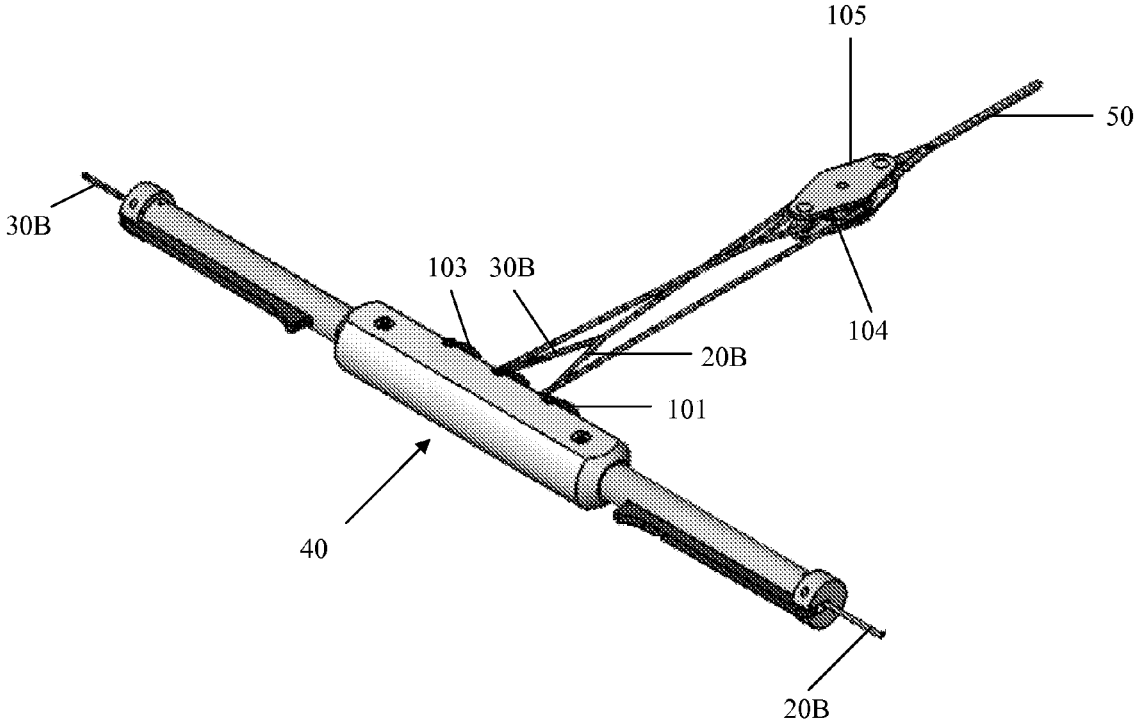
FIG. 4C shows a right, rear perspective view of the assembly of FIG. 4A.
Figure 4D:
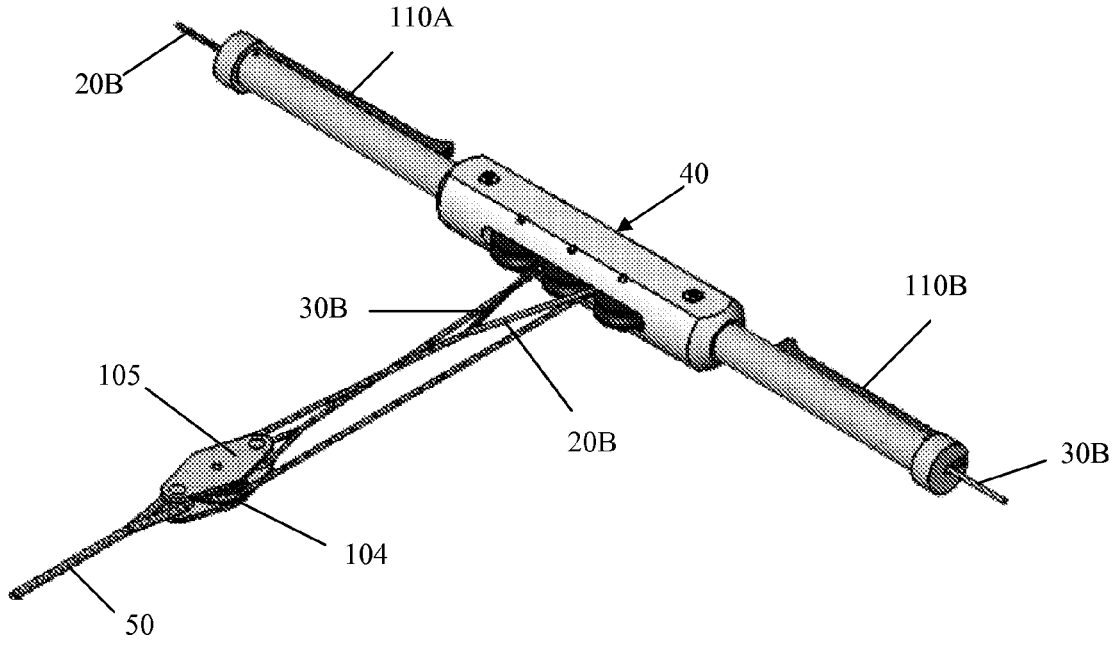
FIG. 4D shows a left, front perspective view of the assembly of FIG. 4A.
Figure 4E:
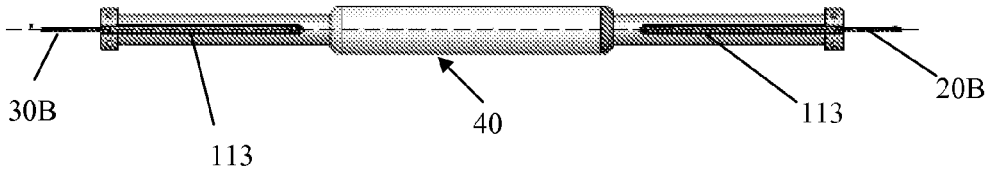
FIG. 4E shows a rear view of the assembly of FIG. 4A.
Figure 4F:
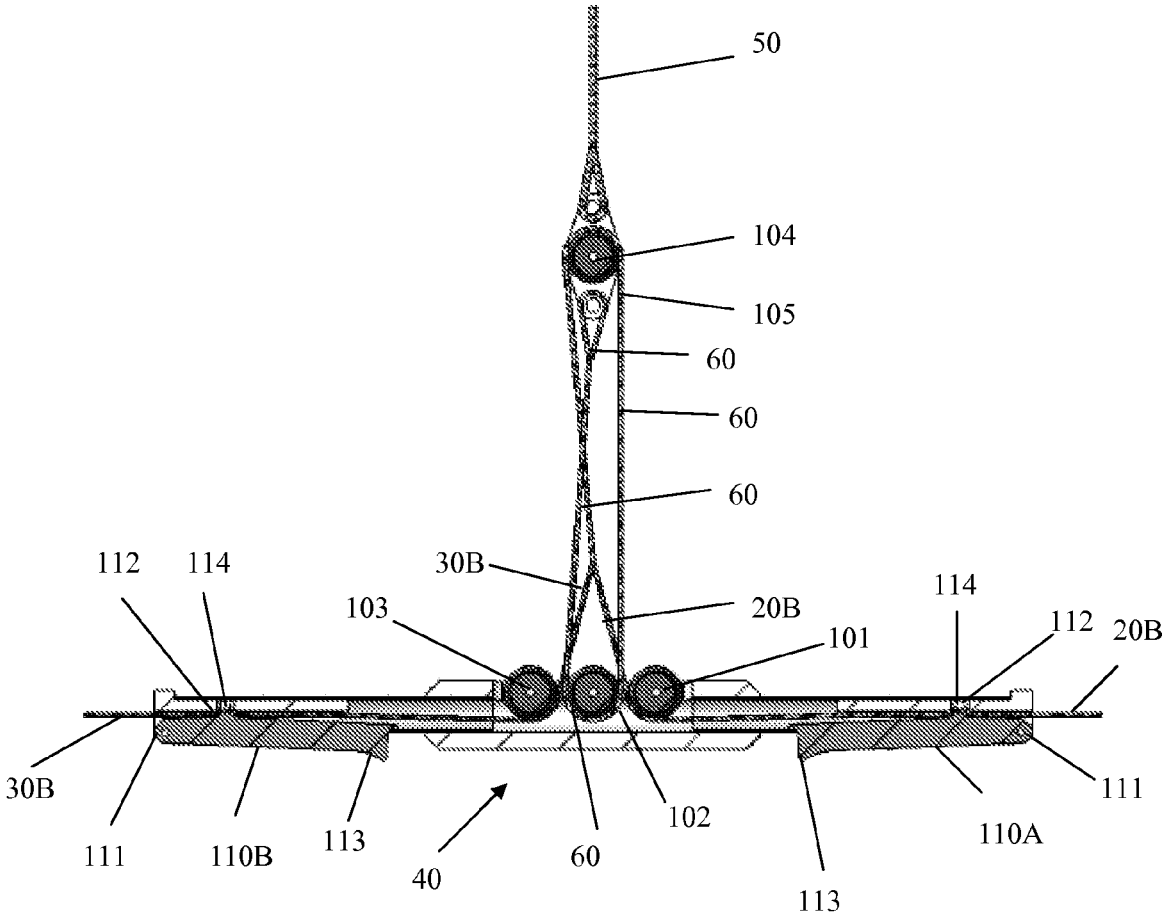
FIG. 4F shows a sectional view of the assembly of FIG. 4E taken along line A-A, with an engagement mechanism in a disengaged position.
Figure 4G:
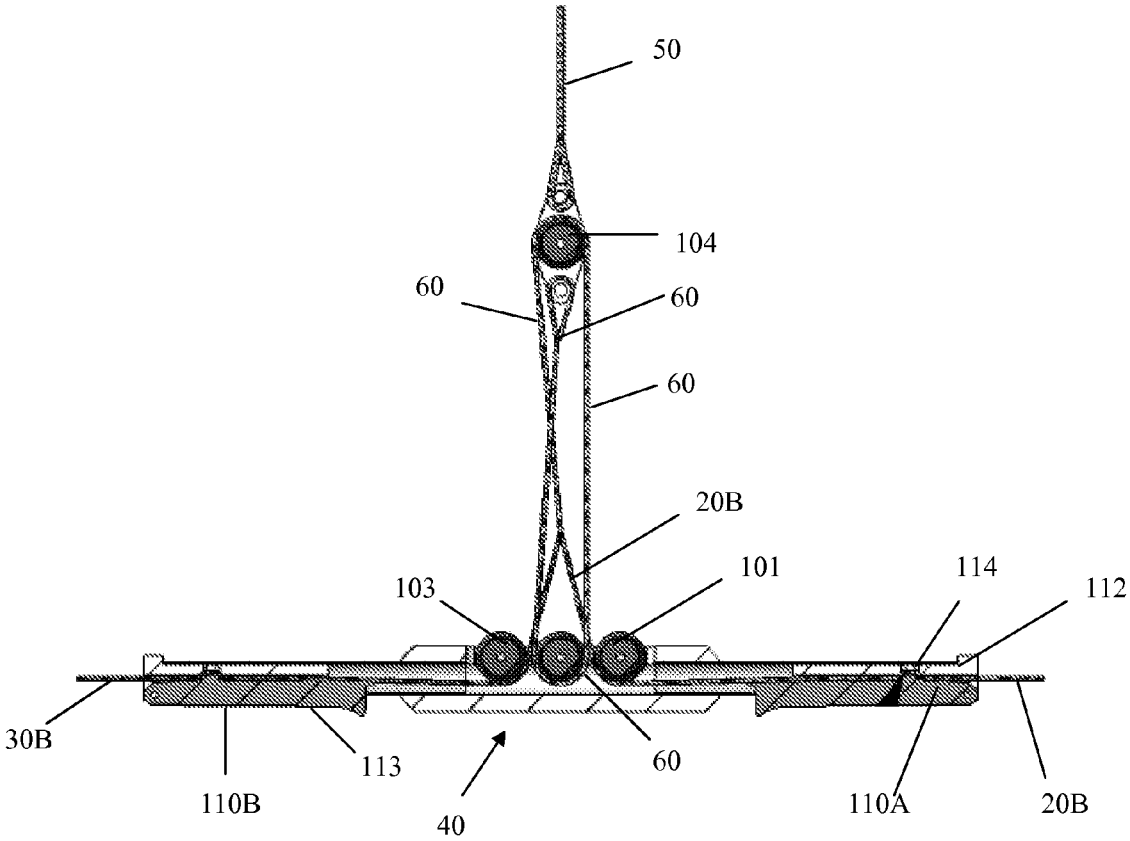
FIG. 4G shows a sectional view of the assembly of FIG. 4E taken along line A-A, with an engagement mechanism in an engaged position.

The system may further include an engagement mechanism for setting the pitch or slowing its change. The engagement mechanism may operate by applying pressure against a line, by frictional engagement or by physically blocking the lines movement. For example, levers or latches may be disposed on handle 40 so that they engage the lines in the channels of the housing. The rider would squeeze the lever or latches causing direct or indirect engagement with the lines locking the angle of attack and the amount of lift. As one possible example, FIGS. 4A-G show right and left levers, respectively levers 110A and 110B, that may be squeezed by a rider's hands to cause the levers to engage lines 20B and 30B, to slow or stop the lines from moving. FIG. 4F shows levers 110A-B before engagement with lines 20B and 30B; FIG. 4G shows levers 110A-B during engagement with lines 20B and 30B. The levers have a pivot end 111 at the ends of the handle. A slot may be provided in the housing so that there is an abutment face of the lever within the housing that abuts the housing and a portion 113 extending through the slot that may engaged by a hand. A protrusion 112 and may be provided on the lever that pushes a line into a notch 114 in the housing for better clamping.

Instead of an engagement mechanism in the form of a manual lever that engages the rear control lines. The engagement mechanism could be automatic, in response to increased tension on towlines coupled to the rear lines. One possible embodiment of an automatic engagement mechanism 210 is shown in FIGS. 5A-5D. This mechanism could replace or supplement the lever-based engagement system of FIGS. 4A-4G. In the figures, the handle portion 40 is removed for ease of illustration. For sake of explanation, only a right engagement mechanism 210 for engaging a rear line 30B is shown, and the right side would be a mirror image. Also, the corresponding front line 20B is not shown, but it would typically be fixed to an end portion of the handle or engagement mechanism 210.

Figure 5A:
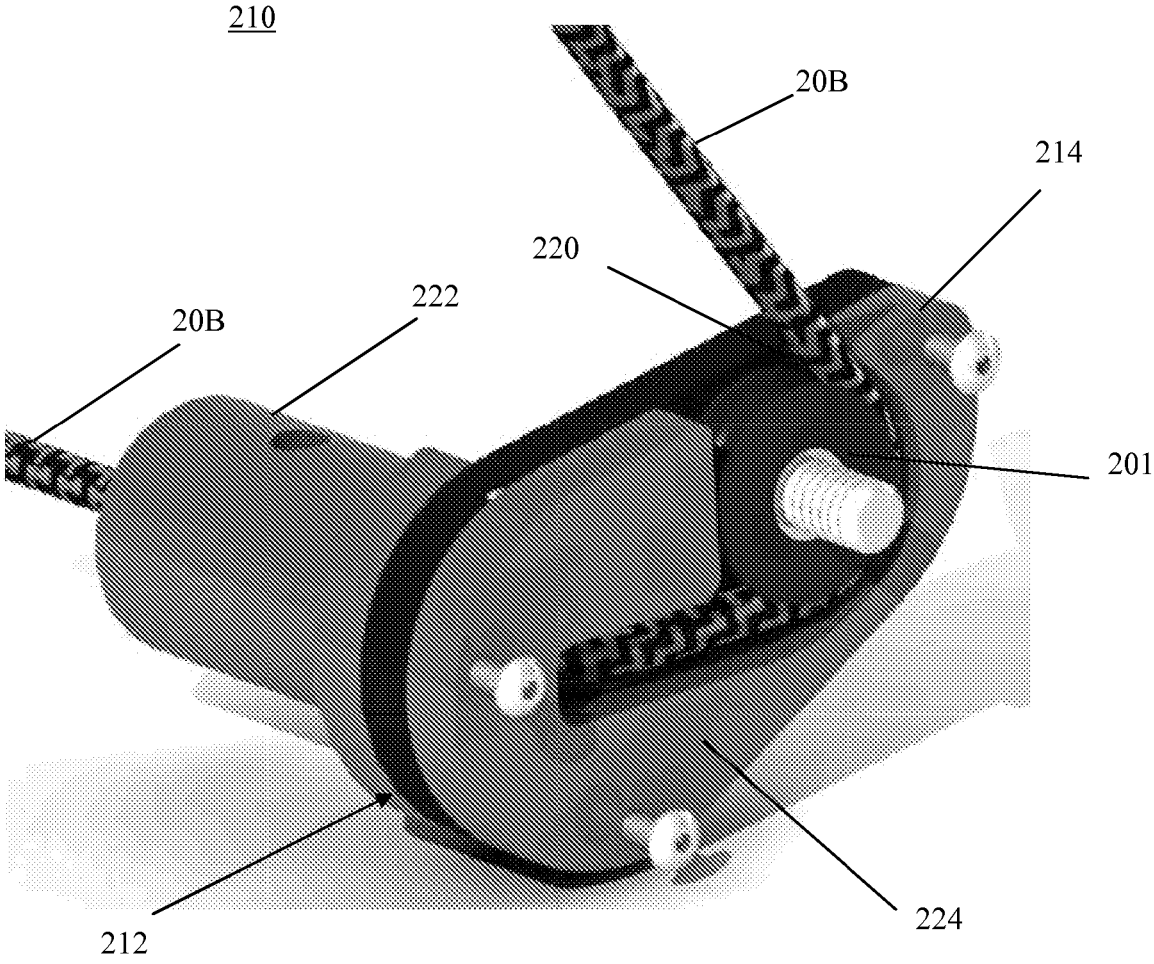
FIG. 5A shows a left front perspective view of an assembly of an alternative embodiment of an automatic engagement mechanism for use in an assembly such as FIG. 4A, the engagement mechanism being shown in a disengage position.
Figure 5B:
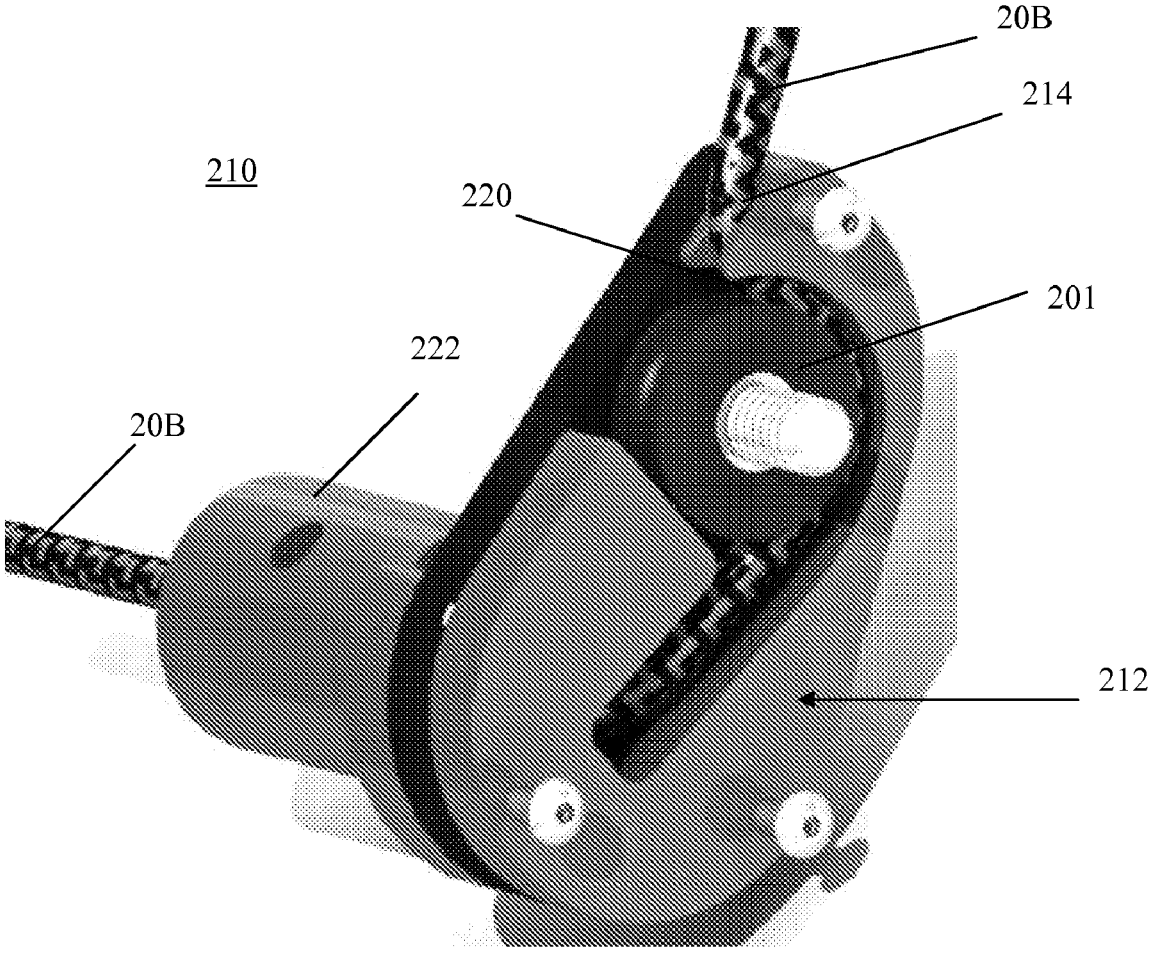
FIG. 5B shows the assembly of FIG. 5A in a rotated, engaged position.
Figure 5C:
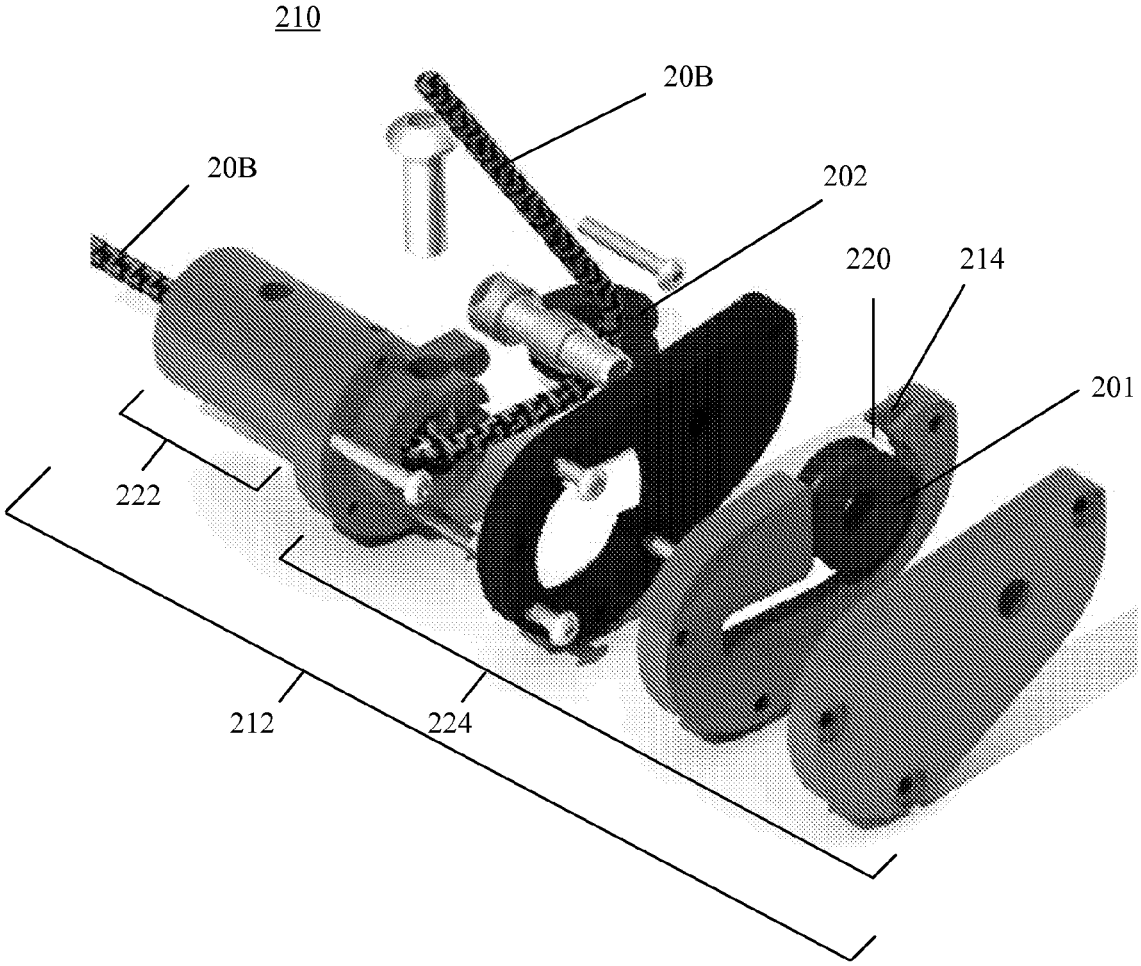
FIG. 5C shows an exploded view of the engagement mechanism of FIG. 5A.
Figure 5D:
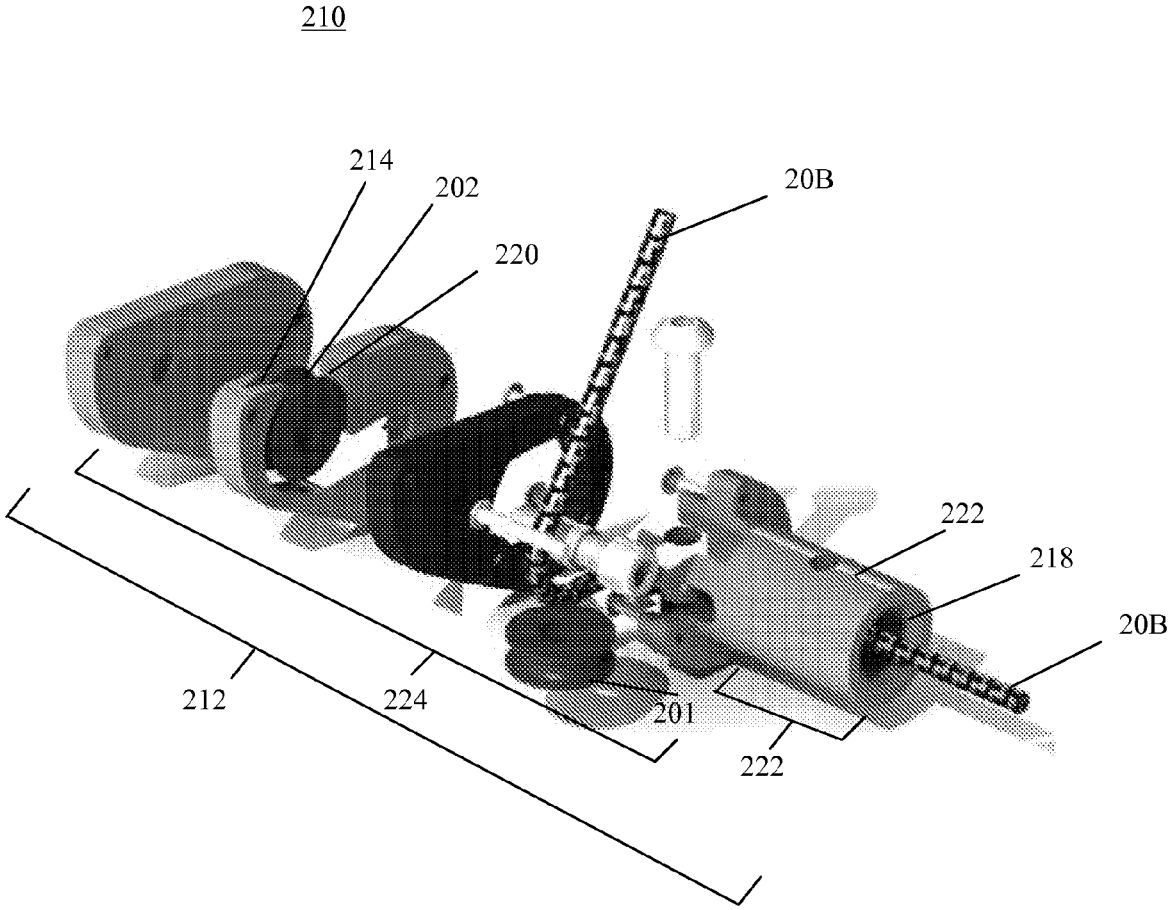
FIG. 5D shows the exploded view of FIG. 5C from the opposite side.
Figure 6A:
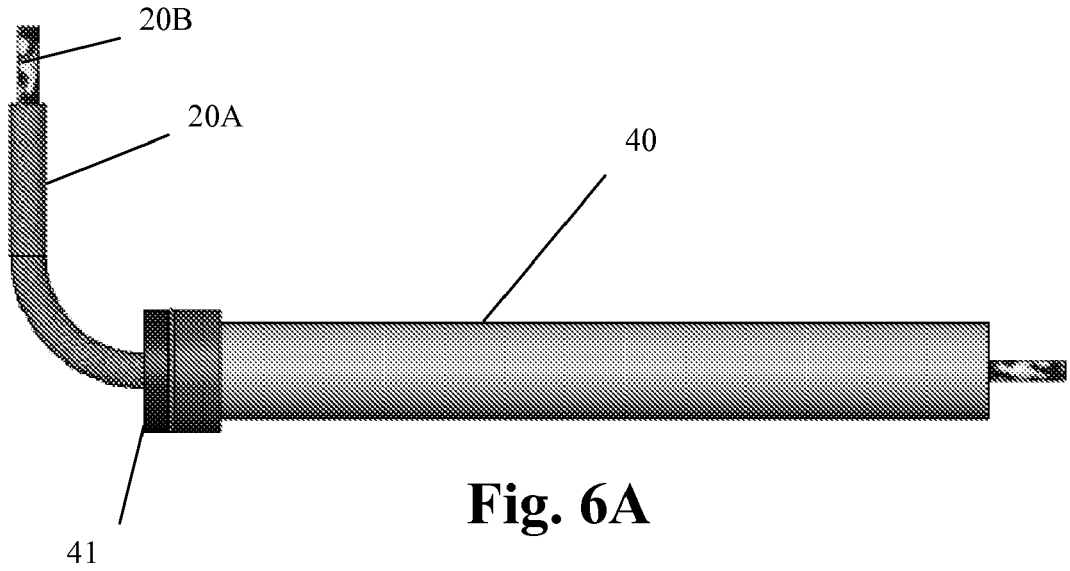
FIG. 6A shows an elevational view of an assembly of a handle (partially shown) and rear and front control lines.
Figure 6B:
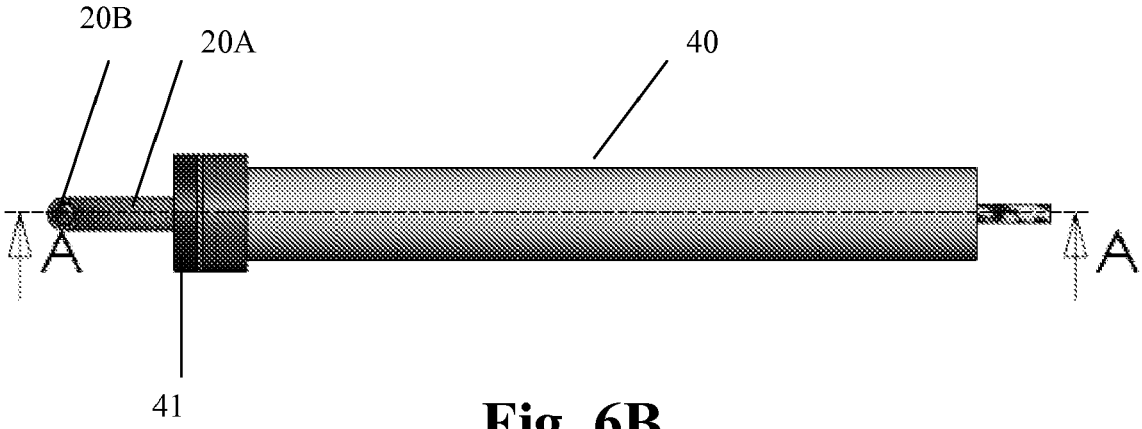
FIG. 6B shows the assembly of FIG. 6A rotated ninety degrees.
Figure 6C:
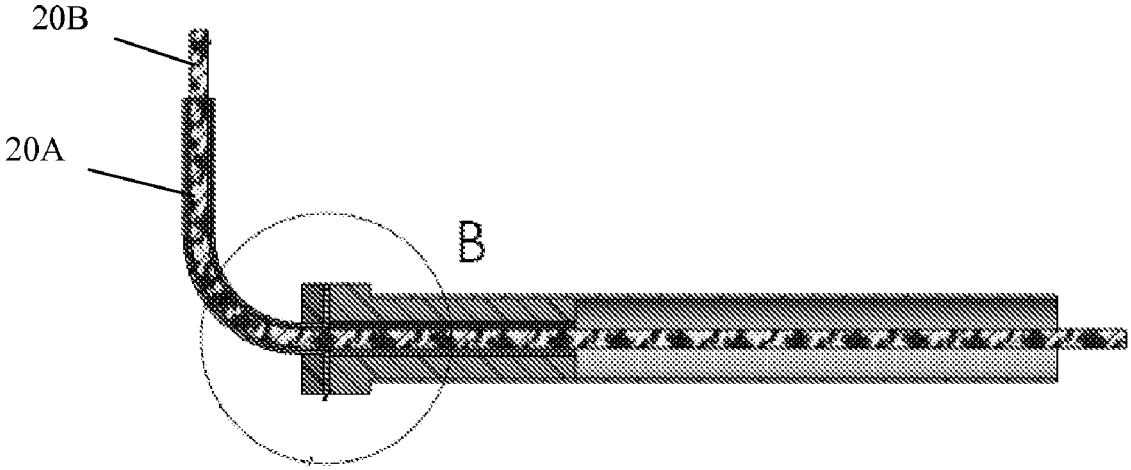
FIG. 6C shows a section view of the assembly of FIG. 6B taken along line A-A.
Figure 6D:
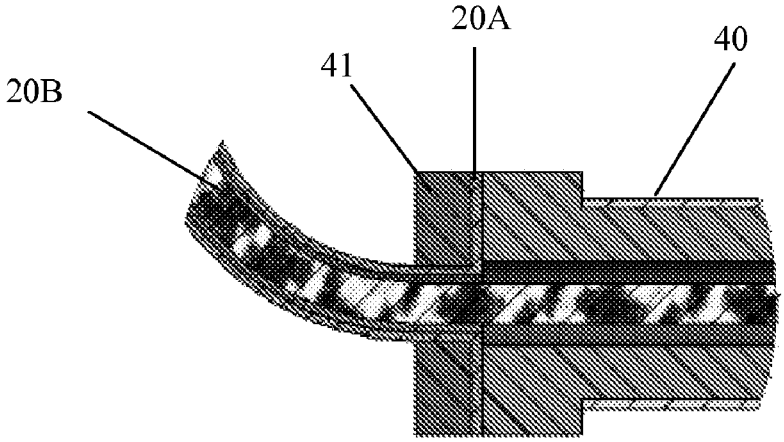
FIG. 6D shows a detailed view of the encircles portion B in FIG. 6C.

FIG. 5A shows right, rear kite line 20B exiting housing 212 around a pulley 201. FIG. 5A represents the engagement mechanism 210 in the orientation it would have when handle 40 in a normal position for towing on the water surface, as seen in FIG. 1A or 4A. When the handle is in this position, the engagement mechanism 210 is disengaged from line 20B, and the line can move freely in response to increasing tension on line 20B from increase in tension of the coupled tow line, as described above, so that there is an effective increase in angle of attack of the kite. The exit 220 also extends forward of the handle 40, towards the towline 50, when the engagement mechanism is disposed at the end of the handle. During a jump, the handle is rotated, ultimately supporting a rider, as seen in FIG. 1B. As the handle is rotated, line 20B moves into tapered slot 214 to engage and lock the line (or increase resistance against movement). FIG. 5B shows the engagement mechanism in the closed position, which locks the line. By locking the line, the angle of attack is set. In this position, the exit is from forward of the handle to even with the handle. The open and closing of the mechanism engagement mechanism is essentially automatic with the natural rotationally movements of the handle by the rider during jumping and riding and in accordance with tension on the towline during edging or tension on the control lines during jumping, whichever tension is dominant. This rotation by the offset of the exit from the center of the handle's longitudinal axis to a forward position (FIG. 5A). The orientation in 5A is achieved when towline tension is dominant.

Looking more closely at the engagement mechanism 210, it includes an entry 218 for receiving a line running in a direction that is parallel to the longitudinal axis of an elongate handle. The line may be routed to entry 218 from a channel in handle 40, or through a housing, or through guides attached to the handle. The entry 218 of the engagement mechanism leads to channel that then routes the line so it passes through an exit 220 in the assembly that orients the line in a generally perpendicular direction to the longitudinal axis of the handle. A line-engagement mechanism may be disposed at the entry, the exit, or somewhere therebetween. The line-engagement element is anything that applies pressure, friction, or physically blocks the movement of the line. In the embodiment illustrated, the line-engagement element has a tapered channel 214 adjacent exit 220. When the handle is rotated from the open position to the closed position, the rotation forces the line into the tapered channel 214, which tapers from a size large enough to receive the line to a size smaller than the line, thereby increasing the resistance on the line as the handle is rotated. Another example of a line engagement element is a jam-cleat.

The housing 212 may be formed of a plurality of portions. A first portion 222 in this example is cylindrical and couples to a cylindrical handle as an insert. This portion is a horizontal routing portion; it has entry 218 for receiving line 20B from handle 40. A second portion 224—a perpendicular routing portion—provides a generally perpendicular routing of the line relative to the routing provided by portion 222. Portion 224 then routes the line around rotatable wheel 201 to the exit 220. The horizontal and perpendicular portions together are joined or otherwise formed to provide a continuous channel for routing of the line from the entry to the exit 220.

At the junction of the perpendicular housing portion and the horizontal housing portion is a rotatable wheel 202 over which the line 20B is routed. The wheel rotates in a plane parallel to the horizontal routing of line. The perpendicular portion of the housing also has rotatable wheel 201 at about the junction of the housing portions. The line is routed over this wheel, which rotates in a direction parallel to the perpendicular routing of the line in the housing. One or both wheels are optional and the pivot points they provide may be replaced by immobile, low friction radiused surfaces, for example. Further, the wheels could have an associated rotary dampener for controlling wheel resistance.

Instead of the tapered line-engagement element, a lever or brake may be included in the control assembly to engage and lock the line or increase pressure against it, to provide resistance against movement. In this case, the line-engagement mechanism is actuated by the rider to lock the line or increase resistance against it, for controlling the angle of attack of the kite or other airfoil.

Figure 8A:
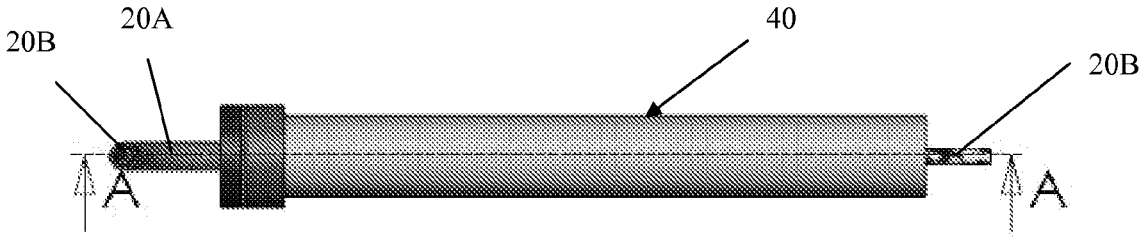
Figure 8B:
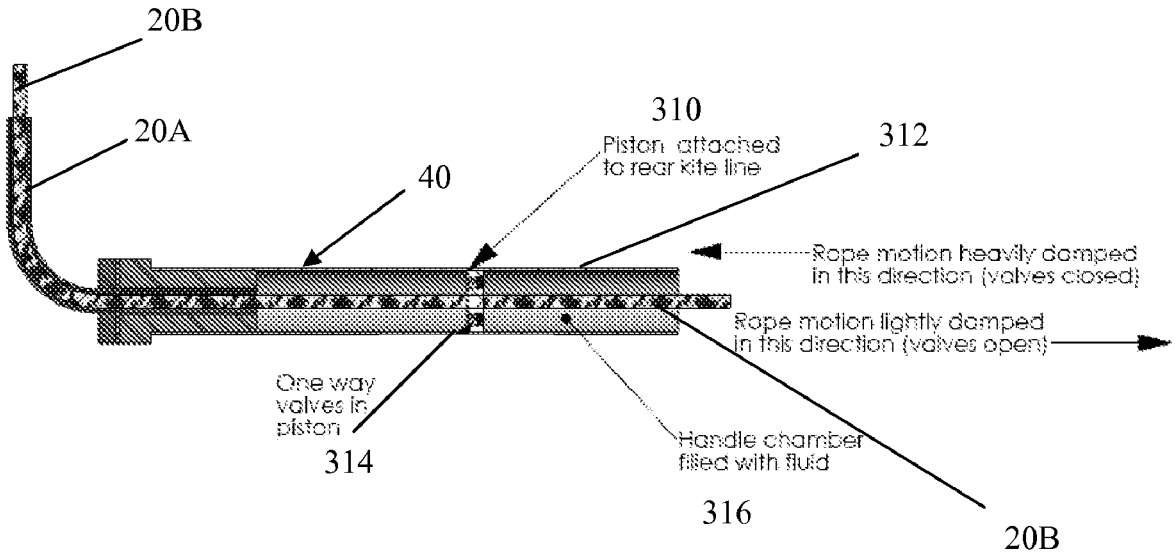
FIG. 8B shows a sectional view of the assembly of FIG. 8A taken along line A-A.

Another possible frictional engagement means is a dampening system in which the travel of the lines is slowed in the direction of the travel of the lines that causes the reduction in the angle of an attack. This allows the angle of attack to be increased quickly for initiating a jump and decreased at a controlled rate during a jump. One example of a dampening mechanism 310, shown in FIGS. 8A-8B, uses a piston element 314 that moves in a cylinder 312. The piston element may be, for example, crimped or formed around a section of the line (e.g., 20B) that moves through a cylinder containing an energy absorbing material 316, such as water or oil based hydraulic fluids. The cylinder may be associated with the handle. The cylinder might be the tubular housing of a handle itself or a tubular structure contained in or on the handle. A variation of a cylinder based fluid dampening system would be a rotary based dampening system.

Another example would be to use energy absorbing polymer materials known to those in the art that will slowly elongate but relatively rapidly contract when an elongation of force is reduced or removed. These dampeners may intervene between sections of line so that they may be associated with the handle or located elsewhere in the line system. In addition to polymer and hydraulic based dampening systems, persons skilled in the art will appreciate that there are a variety of mechanical dampening springs that will achieve the same effects.

Figure 7A:
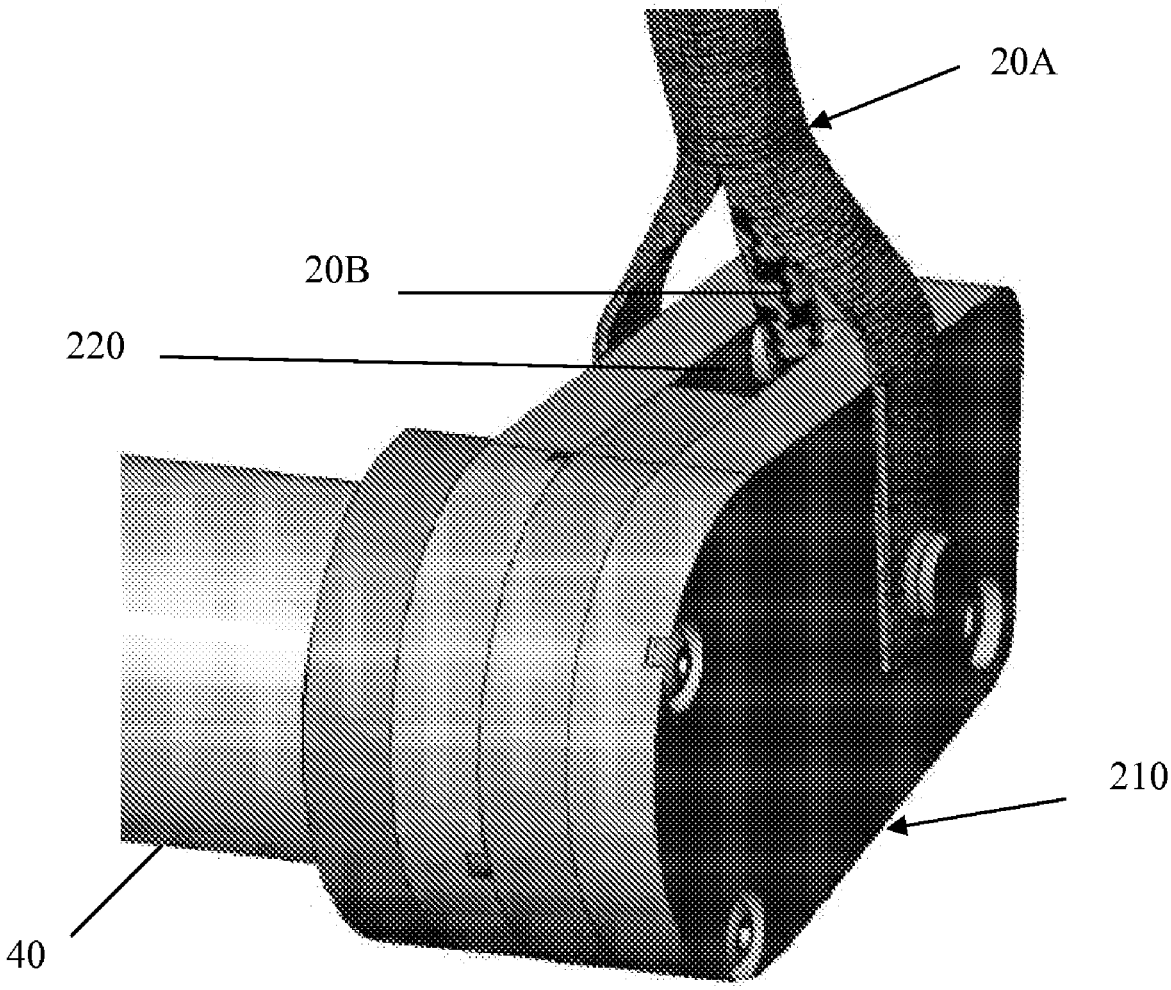
FIG. 7A shows a rear perspective view of an assembly of the engagement mechanism of FIG. 5A with a handle (partially shown) and rear and front control lines.
Figure 7B:
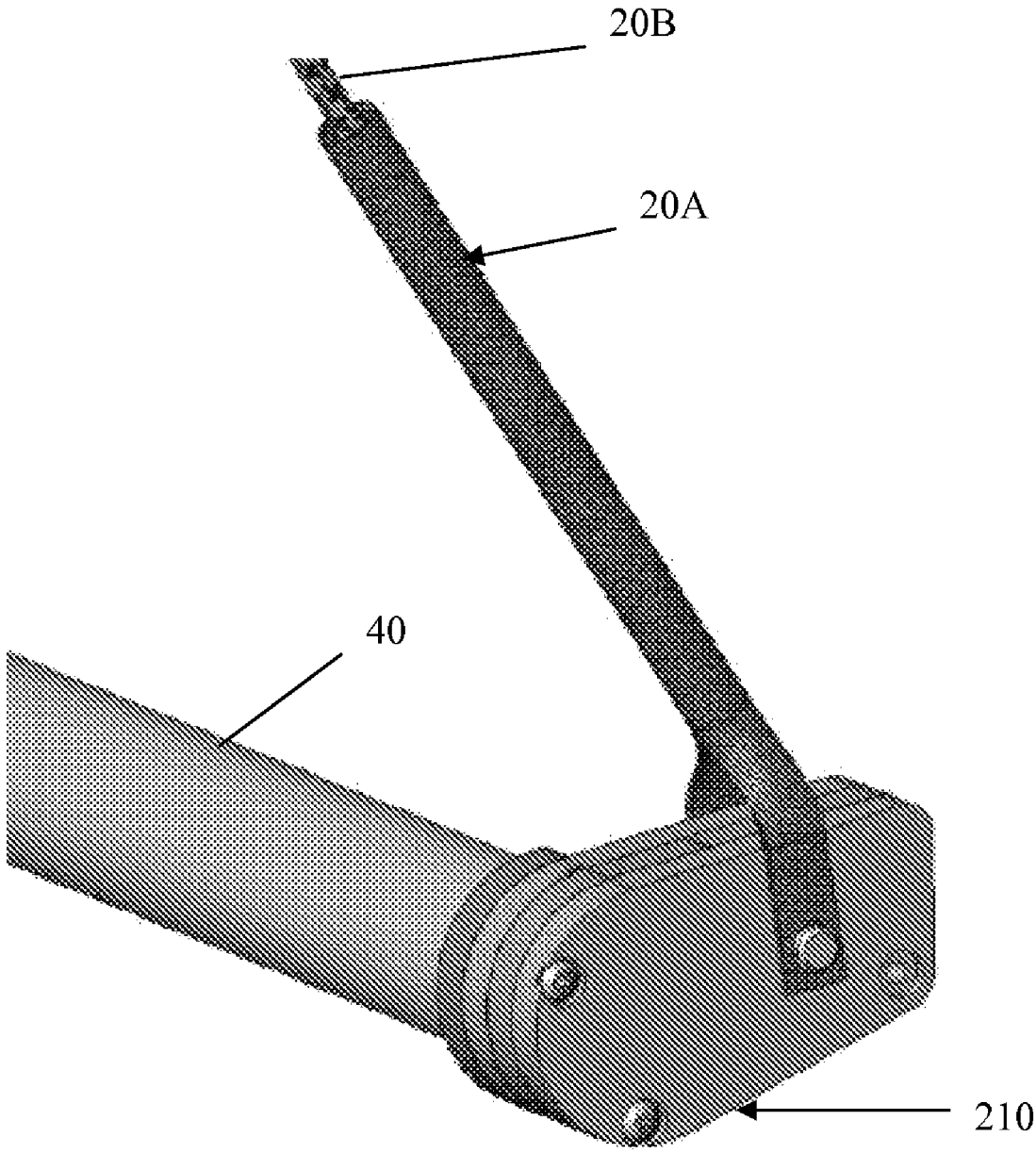
FIG. 7B shows side perspective view of the assembly of FIG. 7A.
Figure 7C:
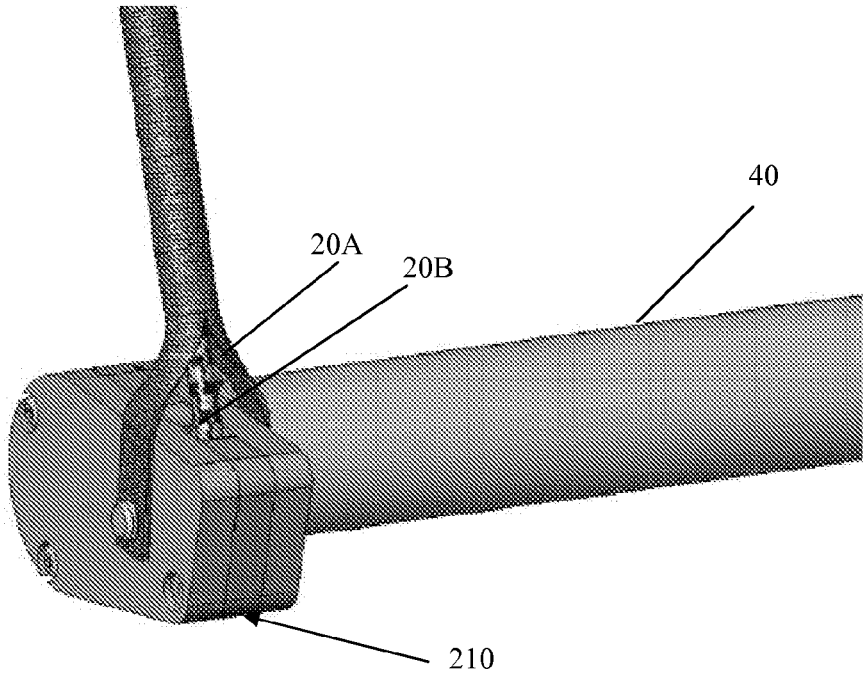
FIG. 7C shows a front perspective view of the assembly of FIG. 7A.

To control the angle of attack and the steering, four lines are generally considered necessary. To simplify the line system, the inventive subject matter contemplates encasing one set of lines in another. In the embodiment shown, the rear (moving) lines 20B and 30B may be slideably encased inside the (static) front lines, as seen in FIGS. 6-8. To enhance slideability of the lines relative to each other, a tubular webbing lined with a polyethylene tube may be used as the static line connected to the handle through which the moving lines run. As seen in FIGS. 6A-D, the webbing may have a flared end that may be clamped between the handle 40 and end cap 41. In the case of the embodiment of FIG. 5, a front control line 20A may be affixed to the housing of the engagement mechanism 210. Polyethylene (PE) has a coefficient of friction that is nearly as low as Teflon and it is much more durable making it an ideal candidate. The exit point at the ends of the bar should exit smoothly to eliminate friction while maintaining flexibility to allow the airfoil to fly at multiple angles. This may be facilitated by providing one or more layers of compliant tubing built into the end of the bar.

While the foregoing has been discussed in terms of a four line system, it is easily adapted to a two line system comprising a forward control line and a rear control line, when steering is not required. Either of the lines may be split for connecting to the left and right sides of the airfoil or in other bridle configurations. A two line system may be implemented as essentially a one line system using the internal routing of one line inside the other as discussed above. As used herein "line" refers not only to full lengths of line necessary to allow towing of rider or kite, but segments of line that may be integrated into a full length line. Lines may be ropes, cables, other filamentous structures, webbings, chains or other flexible elongate structures suitable for towing a kite or rider.

Flexible casings, such as tubes, may be used over any of the line systems discussed herein to protect the lines, to stiffen against entanglement, or reduce drag in water.

Miscellaneous

Generally the kite is controlled by holding the handle with both hands spread evenly on the handle. Steering the kite is similar to steering a car: tip the handle left to go left; tip the handle right to go right. The handle should be released if the kite is steering into the water.

The kite may be used to a rider's advantage. Allow the kite to gently pull the rider into turns and cuts. Attempting to maneuver without steering kite in the same direction of travel will result in the skier/rider working against the kite. The kite may be out of immediate view to the rider requiring the rider to glance up or back to see kite position. If the kite is heading in to crash, let go of the handle. The kite is best steered with both hands spread evenly on the handle. However, the rider may hold on (and even steer) with just one hand provided that the gripping hand is positioned at the center of the handle. A small grip bump may be located at the center of the handle to act as a reference.

The kite should not be used in windy conditions. If a small, unavoidable breeze is present, it is best to drive directly into it. Wind can upset kite behavior, especially tail winds and cross winds. A cross wind can cause the kite lean to one side or another, presenting a challenge for straight steering. A tail wind can cause the kite to suddenly lose power and crash suddenly If the kite behaves erratically when wind conditions are calm and the skier/rider is steering correctly, check again to see that all lines and parts are properly connected and not damaged.

Driving with a kite is much like driving for standard wakeboarding, for example, yet with several important distinctions. The additional kite, lines and any release components must be understood by the driver as well as the boat observer, boat occupants and the skier/rider. A team approach to handling and recovering the kite equipment (and rider) should be instituted by a minimum 3-person crew—the driver, observer and rider.

In using a kite, observe local state and federal laws pertaining to safe distances from docks, boats, shoreline, etc. A safe and reasonable distance should be maintained around the kite operating areas. Suggested minimum obstruction-free distances are as follows: 150 clear feet above the boat; 250 clear feet on either side of the boat and/or skier/ride: 250 clear feet behind the skier/rider; 400 clear feet in front of the boat and/or direction of travel. Items such as other boats, watercraft, swimmers, shoreline, logs, rocks, trees, bushes, bridges, power lines, cables, buoys, structures, pilings and docks are examples of obstructions that must be avoided and kept clear of the obstruction free zone. note: this is not a complete list of obstructions. Standard wakeboarding speeds of 18-24 M.P.H. are recommended for using the towed kite products and must not be exceeded or there is risk of injury and property damage. The driver and rider and observer must be mindful of existing conditions to determine if even the recommended range is safe under the circumstances. The rider must instruct the driver on their comfort level and desired boat speed prior to starting out and speeds.

Persons skilled in the art will recognize that many modifications and variations are possible in the details, materials, and arrangements of the parts and actions which have been described and illustrated in order to explain the nature of this inventive concept and that such modifications and variations do not depart from the spirit and scope of the teachings and claims contained therein.

The invention claimed is:

1. A handle system for controlling the pitch of an airfoil, comprising:

a housing with a channel for a first kite control line to be movably routed, and a channel for a second kite control line to be movably routed;

the channels having a first opening or openings that allow the control lines to extend forward of the handle for coupling with a tow line;

the channels having second openings that allow the control lines to extend upwardly for coupling to an airfoil; and wherein the channels are arranged so that an increase in tension of a coupled towline is translated to the control lines.

2. The handle system of claim 1 further comprising at least one engagement mechanism arranged, the mechanism being engageable against the one or movable control lines to lock or brake them.

3. The handle system of claim 2 wherein the engagement mechanism comprises levers that depress against a line.

4. The handle system of claim 2 wherein the engagement mechanism comprises a line engagement element arranged in the system so that rotation of the handle from a normal position used in towing over a surface to a second causes the line engagement element to engage the one or more control lines to lock or brake them.

5. The handle of claim 4 wherein the line engagement element comprises a tapered slot or a jam-cleat.

6. The handle system of claim 1 further comprising left and right rear control lines routed through the handles, the left and right control lines being the movable control lines.

7. The handle system of claim 1 further comprising one or more pulleys associated with the handle so that the movable control lines are coupleable around the one or more pulleys and to a tow line so that the translated tension on the control lines is divided by a factor other than 1:1.

8. The handle system of claim 7 further comprising left and right rear control lines routed through the handles and around first pulley that is disposed forward of the handle, and the first pulley receives a single section of line coupled to the left and right control lines, and wherein the left and right control lines are the movable control lines.

9. The handle system of claim 8 further comprising at least one pulley disposed in the handle housing around which the single section of line is disposed.

10. The handle system of claim 9 further comprising second and third pulleys disposed in the handle around which the left and right control lines are respectively disposed in routing from the first openings of the handle to the second openings.

11. The handle system of claim 10 wherein in the first opening or openings are disposed in a central portion of the housing, and the second openings are disposed at ends of the handle.

12. The handle system of claim 6 wherein a set of left and right front control lines are coupled to the handle.

13. The handle system of claim 12 wherein the left and right rear lines exit the housing respectively into channels of the left and right front control lines.

14. The handle system of claim 2 wherein the engagement mechanism is a dampening element which allows for relatively rapid increase of angle of attack on tensioning of the tow line and relatively slow decrease of angle of attack on reduction or removal of the tensioning force.

15. A pitch control system for a towable air foil, comprising:

a handle and at least two control lines for coupling to an airfoil, and at least one line for coupling to a towline to a tow vehicle, the one line for coupling being movably associated with the handle, and the control lines are coupled to the line that is coupleable to the tow line so that tension on the towline is transferred to the control lines;

an engagement mechanism for engaging at least one of the lines so that when the control lines are coupled to a kite, the pitch of the kite may be set by engaging the engagement mechanism.

16. The pitch control system of claim 15 further comprising an air foil sized and shaped for towing behind a vehicle and assisting a rider with lift for controlled jumps, the airfoil including coupling for coupling to the control lines.

17. A method of using an airfoil, comprising:

providing a rider a handle system enabling pitch control over an airfoil, the handle system also including front and rear control lines for coupling to front and rear positions at the left side of an airfoil, and front and rear control lines for coupling to front and rear positions at the right side of the air foil; and wherein the system is configured to translate tension from a tow line coupled to the handle system to the rear control lines to cause change in pitch of the airfoil.

18. The method of claim 17 further comprising providing the airfoil for coupling to the handle system.

19. The method of claim 17 further comprising coupling the handle system to the tow line of a tow vehicle.

20. The method of claim 18 wherein the airfoil is configured for towing and launching off a water surface, and the tow vehicle is a boat or other watercraft.

21. A handle system having one or more control lines for coupling to an air foil and either a tow line of a tow vehicle or a line for coupling to a tow line of a tow vehicle, and a tension translation mechanism that divides the tension from the tow line to the one or more control lines by a prederemined factor.

22. The handle system of claim 21 further comprising an engagement mechanism for engaging the one or more control lines to lock or brake a line.

23. The handle system of claim 22 wherein the engagement mechanism automatically locks or brakes a line upon rotation of the handle.

24. The handle system of claim 21, wherein there is an offset exit for a control line relative to about the center of the handle so that a dominant towline tension keeps the engagement disengaged and a dominant control line causes rotation so that the engagement mechanism is engaged.

25. The handle system of claim 22 wherein the engagement mechanism comprises a dampener associated with the handle and coupleable to one or more control lines that movably couple to a tow line.

* * * * *